US006641987B2

(12) United States Patent
Suga et al.

(10) Patent No.: US 6,641,987 B2
(45) Date of Patent: Nov. 4, 2003

(54) SILVER HALIDE PHOTOGRAPHIC LIGHT-SENSITIVE MATERIAL

(75) Inventors: Yoichi Suga, Minami-Ashigara (JP); Hideto Ikoma, Minami-Ashigara (JP); Jun Okamoto, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/820,010

(22) Filed: Mar. 29, 2001

(65) Prior Publication Data

US 2002/0042030 A1 Apr. 11, 2002

(30) Foreign Application Priority Data

Mar. 29, 2000 (JP) ..... 2000-091212

(51) Int. Cl.[7] ..... G03C 1/46

(52) U.S. Cl. ..... 430/505; 430/503; 430/504; 430/506; 430/544

(58) Field of Search ..... 430/503, 504, 430/505, 506, 544

(56) References Cited

U.S. PATENT DOCUMENTS

| | | | | | |
|---|---|---|---|---|---|
| 5,436,121 | A | * | 7/1995 | Suga et al. | 430/504 |
| 5,455,146 | A | * | 10/1995 | Nishikawa et al. | 430/383 |
| 5,482,826 | A | * | 1/1996 | Okamura et al. | 430/569 |
| 5,665,530 | A | * | 9/1997 | Oyamada et al. | 430/567 |
| 6,461,803 | B1 | * | 10/2002 | Suga et al. | 430/505 |

OTHER PUBLICATIONS

Kodak.com, Consumer Product Information, Kodak Max Film.*

Fujifilm.com, Consumer:film, and Consumer:One–Time–Use Cameras.*

Cited by applicant in in IDS filed Mar. 39, 2001 (applicant simply stated that the film exists. No document provided): Fujicolor X–TRA 800 (a color negative film having an ISO of 800, color saturation value of —18.6). Fuji Photo Film Co., Ltd.*

Cited by applicant in IDS filed Mar. 39, 2001(applicant simply stated that the document exists. NO document provided): Kodak Max 800 (a color negative film having an ISO of 800, color saturation value of —17.0). Eastman Kodak Company.*

Cited by applicant in IDS filed Mar. 39, 2001 (applicant simply stated that the film exists. No document was provided): Konica Centuria 800 (a color negative film having an ISO of 800, color saturation value of —19.8). Konica Corporation.*

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

Disclosed is a silver halide color photographic light-sensitive material including at least one red-sensitive silver halide emulsion layer, at least one green-sensitive silver halide emulsion layer, and at least one blue-sensitive silver halide emulsion layer on a support, and having an ISO sensitivity of 640 or more, wherein the material exhibits a color saturation evaluation value η, represented by equation (I) below, of −15 dB or more.

$$\eta = 10\ log(1/V_T)$$

$$[V_T = (1/6) \times ((62-Y_1)^2 + (62-Y_2)^2 + (62-Y_3)^2 + (62-Y_4)^2 + (62-Y_5)^2 + (62-Y_6)^2)] \quad \text{(I)}$$

In Formula (I), each of Y1 to Y6 is a value obtained by exposing 12 colors of a Macbeth color chart with six exposure amounts, from −1 under to +4 over, measuring the saturation of each resultant color, and averaging the data (chroma values) for a corresponding exposure amount.

22 Claims, No Drawings

SILVER HALIDE PHOTOGRAPHIC LIGHT-SENSITIVE MATERIAL

CROSS-REFERENCE TO RELATED APPLICATIONS

This application is based upon and claims the benefit of priority from the prior Japanese Patent Application No. 2000-091212, filed Mar. 29, 2000, the entire contents of which are incorporated herein by reference.

BACKGROUND OF THE INVENTION

The present invention relates to a color photographic light-sensitive material and, more particularly, to a color photographic light-sensitive material having high color saturation in a wide exposure region.

Recently, the development of zoom compact cameras is being sought, and zoom cameras having high magnifications, e.g., three-fold zooming and four-fold zooming are most often used. These zoom cameras are useful to lightheartedly enjoy photographing, but the fact is that they are not always satisfactory in image quality. For example, some cameras have lens F values exceeding 10 at the telephoto end and often cause underexposure. Also, since the range of an electronic flash is short, the light cannot reach an object to cause underexposure in many instances.

Advanced Photo System (to be abbreviated as APS hereinafter) having a frame size smaller than that of the conventional 135 format was put on the market in 1996, and the miniaturization of cameras is progressing by using this small format. With this miniaturization of cameras, electronic flashes of some cameras are also downsized. Accordingly, the ratio of photographic failures caused by the inability of an electronic flash to reach an object are increasing in APS.

In recent years, high-speed light-sensitive materials have been put on the market one after another with the progress of photographic light-sensitive material technologies. Since high-speed-films can "photograph in dark places", they are used in dark rooms more frequently. In Japan, fluorescent lamps are often used as room lamps, so portions illuminated by fluorescent lamps are printed in greenish colors. The higher the sensitivity of a film, the more strongly the film is influenced by a background light source. Hence, the frequency of appearance of greenish prints caused by fluorescent lamps is increased more by an ISO 400 film than an ISO 100 film, and by an ISO 800 film than an ISO 400 film. Fuji Photo Film Co., Ltd. has developed the "SUPER 400" color negative film having color reproduction faithful to human eyes, and thereby has improved the light source suitability of an ISO 400 film. In this film, faithful color reproduction is implemented by the fourth color-sensitive layer and by shortening the wavelength of the spectral sensitivity of a red-sensitive layer. It is readily possible to predict that the light source suitability of an ISO 800 film can be improved by applying these technologies to the film. However, introducing the fourth color-sensitive layer and shortening the wavelength of spectral sensitivity are disadvantageous from a sensitivity viewpoint. If this insufficient sensitivity is compensated for by increasing the grain size, the graininess deteriorates. Therefore, introducing these technologies to an ISO 800 film has been difficult.

BRIEF SUMMARY OF THE INVENTION

It is an object of the present invention to provide a silver halide color photographic light-sensitive material by which photographs having high color saturation over a wide exposure region can be obtained even by a compact camera or a throwaway camera.

The present inventors made extensive studies and have found that the object of the present invention is achieved by the following means.

(1) A silver halide color photographic light-sensitive material comprising, on a support, a red-sensitive layer unit including at least one red-sensitive silver halide emulsion layer, a green-sensitive layer unit including at least one green-sensitive silver halide emulsion layer, and a blue-sensitive layer unit including at least one blue-sensitive silver halide emulsion layer, the light-sensitive material having an ISO sensitivity of not less than 640, wherein the material exhibits a color saturation evaluation value η, represented by equation (I) below, of not less than −15 dB:

$$\eta = 10\,log(1/V_T)$$

$$[V_T = (1/6)\times((62-Y_1)^2+(62-Y_2)^2+(62-Y_3)^2+(62-Y_4)^2+(62-Y_5)^2+(62-Y_6)^2)] \quad \text{(I)}$$

where each of Y1 to Y6 is a value obtained by exposing 12 colors of a Macbeth color chart with six exposure amounts, from −1 under to +4 over, measuring the saturation of each resultant color, and averaging the data (chroma values) for a corresponding exposure amount.

(2) The silver halide color photographic light-sensitive material described in (1), wherein a weight-average wavelength $\lambda_R$, represented by equation (II) below, of the red-sensitive silver halide emulsion layer is not more than 625 nm:

$$\lambda_R = \frac{\int_{550}^{700} \lambda S_R(\lambda)\,d\lambda}{\int_{550}^{700} S_R(\lambda)\,d\lambda} \quad \text{(II)}$$

where $S_R(\lambda)$ is the spectral sensitivity distribution curve of the red-sensitive silver halide emulsion layer, and SR at a specific wavelength λ is represented by the reciprocal of an exposure amount by which a cyan density is fog +0.5 when exposed to the specific wavelength.

(3) The silver halide color photographic light-sensitive material described in (2), wherein the weight-average wavelength $\lambda_R$ of the red-sensitive silver halide emulsion layer is 600 to 620 nm.

(4) The silver halide color photographic light-sensitive material described in (1), wherein 50% or more of the total projected area of silver halide grains contained in at least one of highest-sensitivity emulsion layer in the unit red-sensitive layer, highest-sensitivity emulsion layer in the unit green-sensitive layer and highest-sensitivity emulsion layer in the unit blue-sensitive layer are tabular silver halide grains having an average aspect ratio of 8 or more.

(5) The silver halide color photographic light-sensitive material described in (4), wherein the tabular silver halide grains have 10 or more dislocation lines per grain in average.

(6) The silver halide color photographic light-sensitive material described in (1), wherein the silver halide emulsion contained in at least one of the silver halide emulsion layers is subjected to selenium sensitization.

(7) The silver halide color photographic light-sensitive material described in (6), wherein the selenium sensitization is subjected by using at least one selected from compounds represented by formulas (A) and (B):

(A)

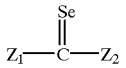

where each of $Z_1$ and $Z_2$ independently represents an alkyl group, an alkenyl group, an aralkyl group, an aryl group, a heterocyclic group, —$NR_1(R_2)$, —$OR_3$, or —$SR_4$, each of $R_1$, $R_2$, $R_3$, and $R_4$ independently represents a hydrogen atom, an alkyl group, an aralkyl group, an aryl group, a heterocyclic group, or an acyl group.

(B)

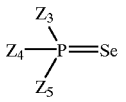

where each of $Z_3$, $Z_4$, and $Z_5$ independently represents an alkyl group, an alkenyl group, an alkinyl group, an aralkyl group, an aryl group, a heterocyclic group, —$OR_7$, —$NR_8(R_9)$, —$SR_{10}$, —$SeR_{11}$, X, or a hydrogen atom, each of $R_7$, $R_{10}$, and $R_{11}$ independently represents an alkyl group, an alkenyl group, an alkinyl group, an aralkyl group, an aryl group, a heterocyclic group, a hydrogen atom, or a cation, each of $R_8$ and $R_9$ independently represents an alkyl group, an alkenyl group, an alkinyl group, an aralkyl group, an aryl group, a heterocyclic group, or a hydrogen atom, and X represents a halogen atom.

(8) The silver halide color photographic light-sensitive material described in (1), wherein a weight-average sensitivity wavelength $\lambda_G$, represented by equation (III) below, of the spectral sensitivity distribution of the green-sensitive silver halide emulsion layer is 520 nm$<\lambda_G\leqq$580 nm, a weight-average wavelength ($\lambda_{-R}$) of the spectral sensitivity distribution of the interlayer effect, which the red-sensitive silver halide emulsion layer is given from other silver halide emulsion layers within the range of 500 to 600 nm, is 500 nm$<\lambda_{-R}\leqq$560 nm, and $\lambda_G-\lambda_{-R}$ is 5 nm or more:

$$\lambda_G = \frac{\int_{500}^{600} \lambda S_G(\lambda)\, d\lambda}{\int_{500}^{600} S_G(\lambda)\, d\lambda} \quad \text{(III)}$$

where $S_G(\lambda)$ is the spectral sensitivity distribution curve of the green-sensitive silver halide emulsion layer, and $S_G$ at a specific wavelength $\lambda$ is represented by the reciprocal of an exposure amount by which a cyan density is fog +0.5 when exposed to the specific wavelength.

(9) The silver halide color photographic light-sensitive material described in (4), wherein the silver halide grains contained in at least one of highest-sensitivity emulsion layer in the unit red-sensitive layer, highest-sensitivity emulsion layer in the unit green-sensitive layer and highest-sensitivity emulsion layer in the unit blue-sensitive layer are doped with at least one dopant selected from Fe, Co, Ni, Ru, Rh, Pd, Re, Os, Ir, Pt, Au, Hg, Pb and Tl.

(10) The silver halide color photographic light-sensitive material described in (9), wherein the dopants are metal complexes selected from a hexacyano iron(II) complex and a hexacyanoruthenium complex.

(11) The silver halide color photographic light-sensitive material described in (10), wherein 50% or more of the total content of metal complexes contained in the silver halide grain are contained in a layer ½ or less as a silver amount from the outermost surface of the grain.

(12) A photographic unit containing the silver halide color photographic light-sensitive material described in any one of items (1) to (11) and comprising an exposure mechanism which includes a photographing lens and shutter.

The present invention made it possible to obtain color negative light-sensitive materials by which photographs having high color saturation over a wide exposure region could be obtained even by a compact camera or a throwaway camera.

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will be described in detail below.

A silver halide color photographic light-sensitive material according to the present invention has high color saturation over a wide exposure region.

In the present invention, an evaluation value $\eta$ of color saturation is defined as follows.

A Macbeth color chart is photographed from −1 under to +4 over and printed on color paper such that the gray balance is optimum, and the saturation is measured on the color paper.

TABLE 1

| Exposure amount | −1 | N | +1 | +2 | +3 | +4 |
|---|---|---|---|---|---|---|
| B | $y_{11}$ | $y_{12}$ | $y_{13}$ | $y_{14}$ | $y_{15}$ | $y_{16}$ |
| G | $y_{21}$ | $y_{22}$ | $y_{23}$ | $y_{24}$ | $y_{25}$ | $y_{26}$ |
| R | $y_{31}$ | $y_{32}$ | $y_{33}$ | $y_{34}$ | $y_{35}$ | $y_{36}$ |
| Y | $y_{41}$ | $y_{42}$ | $y_{43}$ | $y_{44}$ | $y_{45}$ | $y_{46}$ |
| M | $y_{51}$ | $y_{52}$ | $y_{53}$ | $y_{54}$ | $y_{55}$ | $y_{56}$ |
| C | $y_{61}$ | $y_{62}$ | $y_{63}$ | $y_{64}$ | $y_{65}$ | $y_{66}$ |
| O | $y_{71}$ | $y_{72}$ | $y_{73}$ | $y_{74}$ | $y_{75}$ | $y_{76}$ |
| PB | $y_{81}$ | $y_{82}$ | $y_{83}$ | $y_{84}$ | $y_{85}$ | $y_{86}$ |
| MR | $y_{91}$ | $y_{92}$ | $y_{93}$ | $y_{94}$ | $y_{95}$ | $y_{96}$ |
| P | $y_{101}$ | $y_{102}$ | $y_{103}$ | $y_{104}$ | $y_{105}$ | $y_{106}$ |
| YG | $y_{111}$ | $y_{112}$ | $y_{113}$ | $y_{114}$ | $y_{115}$ | $y_{116}$ |
| OY | $y_{121}$ | $y_{122}$ | $y_{123}$ | $y_{124}$ | $y_{125}$ | $y_{126}$ |
| Average | Y1 | Y2 | Y3 | Y4 | Y5 | Y6 |

In Table 1, B, G, R, Y, M, C, O, PB, MR, P, YG, and OY are 12 colors of the Macbeth chart. These 12 colors are exposed with exposure amounts divided step by step. $Y_{ij}$ is data (a chroma value) obtained by measuring the saturation. Each of Y1 to Y6 represents the average value of the exposure amount data of a corresponding column (exposure amount).

An ideal state of saturation is defined that the saturation is high and remains unchanged for any exposure amount. Assuming that the upper-limiting average value of the values of saturation of the 12 colors of the Macbeth chart on the color paper is 62, the color saturation evaluation value η is defined by equation (I):

$$\eta=10\ log(1/V_T)$$

$$[V_T=(1/6)\times((62-Y_1)^2+(62-Y_2)^2+(62-Y_3)^2+(62-Y_4)^2+(62-Y_5)^2+(62-Y_6)^2)] \quad (I)$$

In a light-sensitive material provided by the present invention, the saturation evaluation value n thus defined is −15 dB or more, preferably −13 dB or more. In the present invention, evaluation values are defined in an exposure region of an aperture value of −1 to an aperture value of +4.However, even in a wide exposure region of an aperture value of −2 or less to an aperture value of +5 or more, the evaluation value η is preferably −15 dB or more, and more preferably, −13 dB or more.

In the present invention, an average chroma value for correct exposure is preferably 52 or more, and more preferably, 55 or more. A fluctuation of the chroma value in the range of −1 under to +4 over is preferably small. More specifically, a fluctuation of the chroma value in this exposure region is preferably 10 or less. Furthermore, it is of course favorable that a chroma fluctuation be small in a wide exposure region of an aperture value of −2 or less to an aperture value of +5 or more.

The ISO sensitivity of a color negative photographic light-sensitive material of the present invention is preferably 640 or more, and more preferably, 800 or more.

A light-sensitive material provided by the present invention has, on a support, a unit blue-sensitive layer made up of at least one blue-sensitive silver halide emulsion layer, a unit green-sensitive layer made up of at least one green-sensitive silver halide emulsion layer, and a unit red-sensitive layer made up of at least one red-sensitive silver halide emulsion layer. In the present invention, a weight-average wavelength $\lambda_R$ of the red-sensitive silver halide emulsion layer preferably falls within a specific range as will be presented below.

In the present invention, the weight-average wavelength $\lambda_R$ of the red-sensitive layer is defined by equation (II):

$$\lambda_R = \frac{\int_{550}^{700} \lambda S_R(\lambda)\, d\lambda}{\int_{550}^{700} S_R(\lambda)\, d\lambda} \quad (II)$$

where $S_R(\lambda)$ is the spectral sensitivity distribution curve of the red-sensitive silver halide emulsion layer, and $S_R$ at a specific wavelength λ is represented by the reciprocal of an exposure amount by which a cyan density is fog +0.5 when exposed to the specific wavelength.

In the present invention, the weight-average wavelength $\lambda_R$ of the red-sensitive silver halide emulsion layer is not more than 625 nm, preferably 595 to 625 nm, and more preferably 600 to 620 nm.

The color correction coefficient of a color negative photographic light-sensitive material of the present invention need not be largely changed for each exposure amount. Since this facilitates color correction in digital processing, the digital processing suitability improves.

An emulsion of the present invention relates to a silver iodobromide, silver bromide, or silver bromochloroiodide tabular grain emulsion.

In a color photographic light-sensitive material of the present invention, each unit light-sensitive layer is preferably made up of a plurality of silver halide emulsion layers sensitive to substantially the same color but different in sensitivity. Also, 50% or more of the total projected area of silver halide grains contained in at least one of highest-sensitivity emulsion layers of the silver halide emulsion layers making up each unit light-sensitive layer are preferably tabular silver halide grains (to be referred to as tabular grains hereinafter). In the present invention, the average aspect ratio of these tabular grains is preferably 8 or more, more preferably, 10 or more, and most preferably, 12 or more.

The aspect ratio of a tabular grain is the ratio of the diameter of a silver halide to its thickness. That is, the aspect ratio is a value obtained by dividing the diameter of each individual grain by its thickness. The "diameter" is the diameter of a circle having an area equal to the projected area of a silver halide grain when the grain is observed by a microscope or an electron microscope. In this specification, the average aspect ratio is the average value of the aspect ratios of all tabular grains in an emulsion.

One example of an aspect ratio measurement method is to take a transmission electron micrograph by a replica method and obtain the equivalent-circle diameter and thickness of each individual grain. In this method, the thickness is calculated from the length of the shadow of a replica.

The shape of a tabular grain in the present invention is usually a hexagon. This hexagonal shape means that the shape of the principal planes of a tabular grain is a hexagon and the adjacent edge ratio (maximum edge length/minimum edge length) of the grain is 2 or less. This adjacent edge ratio is preferably 1.6 or less, and more preferably, 1.2 or less. The lower limit is, of course, 1.0. Especially in high-aspect-ratio grains, triangular tabular grains increase in amount in tabular grains. Triangular tabular grains appear when Ostwald ripening excessively progresses. To obtain substantially hexagonal tabular grains, the time of this ripening is preferably made as short as possible. To this end, it is necessary to manage to increase the ratio of tabular grains by nucleation. As described in Jpn. Pat. Appln. KOKAI Publication No. (hereinafter referred to as JP-A-) 63-11928 by Saito, the disclosure of which is incorporated herein by reference, to increase the probability of generation of hexagonal tabular grains when silver ions and bromide ions are added to a reaction solution by the double-jet method, one or both of the aqueous silver ion solution and the aqueous bromide ion solution preferably contain gelatin.

Hexagonal tabular grains contained in a light-sensitive material of the present invention are formed by nucleation, Ostwald ripening, and growth steps. In any of these steps, it is important to suppress the spread of the grain size distribution. Since the spread of the size distribution produced in any of the above steps cannot be narrowed in the subsequent steps, caution should be exercised so as not to spread the size distribution in the first nucleation process. An important factor in the nucleation process is the relationship between the nucleation time, during which silver ions and bromide ions are added to a reaction solution by the double-jet method to form a precipitation, and the temperature of the reaction solution. JP-A-63-92942 by Saito, the disclosure of which is incorporated herein by reference, describes that the temperature of the reaction solution during nucleation is preferably 20 to 45° C. in order to improve the monodispersibility. Also, JP-A-2-222940 by Zola et al., the disclosure of which is incorporated herein by reference, describes that the temperature of nucleation is preferably 60° C. or less.

To obtain high-aspect-ratio, monodisperse tabular grains, gelatin is sometimes added during grain formation. As this gelatin, chemically modified gelatin described in JP-A's-10-148897 and 11-143002, the disclosures of which are incorporated herein by reference, is preferably used. This chemically modified gelatin is characterized in that two or more carboxyl groups are introduced when an amino group in the gelatin is chemically modified. Although the use of trimellitated gelatin is preferred, succinated gelatin is also favorably used. This gelatin is added preferably before the growth step, and more preferably, immediately after nucleation. The addition amount is preferably 60% or more, more preferably, 80% or more, and particularly preferably, 90% or more with respect to the weight of all dispersing media in grain formation.

A tabular grain emulsion consists of silver iodobromide or silver bromochloroiodide. Although the emulsion can also contain silver chloride, the content of this silver chloride is preferably 8 mol % or less, more preferably, 3 mol % or less, and most preferably, 0 mol %. The content of silver iodide is preferably 20 mol % or less, since the variation coefficient of the distribution of grain sizes in a tabular grain emulsion is preferably 30% or less. Reducing the silver iodide content facilitates decreasing the variation coefficient of the distribution of grain sizes of a tabular grain emulsion. In particular, the variation coefficient of the distribution of grain sizes of a tabular grain emulsion is preferably 20% or less, and the silver iodide content is preferably 10 mol % or less.

A tabular grain emulsion used in the present invention preferably has a silver iodide distribution structure inside a grain. This silver iodide distribution structure can be a double structure, a triple structure, a quadruple structure, or a structure of higher order.

In the present invention, tabular grains have dislocation lines. Dislocation lines in tabular grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). From photographs of grains obtained by the above method, it is possible to obtain the positions and the number of dislocations in each grain viewed in a direction perpendicular to the principal planes of the grain.

The average number of dislocation lines is preferably 10 or more, and more preferably, 20 or more per grain. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains. Several hundreds of dislocation lines are sometimes found.

Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular grain can have dislocation lines either almost uniformly across the whole peripheral region or at a particular position of the peripheral region. That is, in the case of a hexagonal tabular silver halide grain, dislocation lines can be limited to either portions near the six corners or only a portion near one of the six corners. In contrast, it is also possible to limit dislocation lines to only portions near the edges except for the portions near the six corners.

Dislocation lines can also be formed across a region containing the centers of two principal planes of a tabular grain. When dislocation lines are formed across the entire region of the principal planes, the direction of the dislocation lines is sometimes crystallographically, approximately a (211) direction with respect to a direction perpendicular to the principal planes. In some cases, however, the direction is a (110) direction or random. The lengths of the individual dislocation lines are also random; the dislocation lines are sometimes observed as short lines on the principal planes and sometimes observed as long lines reaching the edges (peripheral region). Although dislocation lines are sometimes straight, they are often zigzagged. In many cases, dislocation lines cross each other.

As described above, the position of dislocation lines can be either limited on the peripheral region or the principal planes or a local position on at least one of them. That is, dislocation lines can be present on both the peripheral region and the principal planes.

Introducing dislocation lines to a tabular grain can be achieved by forming a specific silver iodide rich phase inside the grain. This silver iodide rich phase can include a discontinuous silver iodide rich region. More specifically, after a substrate grain is prepared, the silver iodide rich phase is formed and covered with a layer having a silver iodide content lower than that of the silver iodide rich phase. The silver iodide content of the substrate tabular grain is lower than that of the silver iodide rich phase, and is preferably 0 to 20 mol %, and more preferably, 0 to 15 mol %.

In this specification, the silver iodide rich phase inside a grain is a silver halide solid solution containing silver iodide. This silver halide is preferably silver iodide, silver iodobromide, or silver bromochloroiodide, and more preferably, silver iodide or silver iodobromide (the silver iodide content with respect to a silver halide contained in this silver iodide rich phase is 10 to 40 mol %). To cause this silver iodide rich phase inside a grain (to be referred to as an internal silver iodide rich phase hereinafter) to selectively exist on the edge, the corner, or the surface of a substrate grain, it is desirable to control the formation conditions of the substrate grain, the formation conditions of the internal silver iodide rich phase, and the formation conditions of a phase covering the outside of the internal silver iodide rich phase. Important factors as the formation conditions of a substrate grain are the pAg (the logarithm of the reciprocal of a silver ion concentration), the presence/absence, type, and amount of a silver halide solvent, and the temperature. By controlling the pAg to preferably 8.5 or less, more preferably, 8 or less during the growth of substrate grains, the internal silver iodide rich phase can be made to selectively exist in portions near the corners or on the surface of the substrate grain, when this silver iodide rich phase is formed later.

On the other hand, by controlling the pAg to preferably 8.5 or more, more preferably, 9 or more during the growth of substrate grains, the internal silver iodide rich phase can be made to exist on the edges of the substrate grain. The threshold value of the pAg rises and falls depending on the temperature and the presence/absence, type, and amount of a silver halide solvent. When thiocyanate is used as the silver halide solvent, this threshold value of the pAg shifts to higher values. The value of the pAg at the end of the growth of substrate grains is particularly important, among other pAg values during the growth. On the other hand, even if the pAg during the growth does not meet the above value, the position of the internal silver iodide rich phase can be controlled by performing ripening by controlling the pAg to the above proper value after the growth of substrate grains. In this case, ammonia, an amine compound, a thiourea derivative, or thiocyanate salt can be effectively used as the silver halide solvent. The internal silver iodide rich phase can be formed by a so-called conversion method.

This method includes a method which, at a certain point during grain formation, adds halogen ion smaller in solubility for salt for forming silver ion than halogen ion that forms grains or portions near the surfaces of grains at that point. In the present invention, the amount of halogen ion having a smaller solubility to be added preferably takes a certain value H(related to a halogen composition) with respect to the surface area of grains at that point. For example, at a given point during grain formation, it is preferable to add a certain amount or more of KI with respect to the surface area of silver halide grains at that point. More specifically, it is preferable to add $8.2\times10^{-5}$ mol/$m^2$ or more of iodide salt.

A more preferable method of forming the internal silver iodide rich phase is to add an aqueous silver salt solution simultaneously with addition of an aqueous silver halide solution containing iodide salt.

As an example, an aqueous $AgNO_3$ solution is added simultaneously with addition of an aqueous KI solution by the double-jet method. In this case, the addition start timings and the addition end timings of the aqueous KI solution and the aqueous $AgNO_3$ solution can be shifted from each other. The addition molar ratio of the aqueous $AgNO_3$ solution to the aqueous KI solution is preferably 0.1 or more, more preferably, 0.5 or more, and most preferably, 1 or more. The total addition molar quantity of the aqueous $AgNO_3$ solution can exit in a silver excess region with respect to halogen ion in the system and iodine ion added. During the addition of the aqueous silver halide solution containing iodine ion and the addition of the aqueous silver salt solution by the double-jet method, the pAg preferably decreases with the addition time by the double-jet. The pAg before the addition is preferably 6.5 to 13, and more preferably, 7.0 to 11. The pAg at the end of the addition is most preferably 6.5 to 10.0.

In carrying out the above method, the solubility of a silver halide in the mixing system is preferably as low as possible. Therefore, the temperature of the mixing system at which the silver iodide rich phase is formed is preferably 30° C. to 80° C., and more preferably, 30° C. to 70° C.

The formation of the internal silver iodide rich phase is most preferably performed by adding fine-grain silver iodide, fine-grain silver iodobromide, Fine-grain silver chloroiodide, or fine-grain silver bromochloroiodide. The addition of fine-grain silver iodide is particularly preferred. These fine grains normally have a grain size of 0.01 to 0.1 μm, but those having a grain size of 0.01 μm or less or 0.1 μm or more can also be used. Methods of preparing these fine silver halide grains are described in JP-A's-1-183417, 2-44335, 1-183644, 1-183645, 2-43534, and 2-43535, the disclosures of which are incorporated herein by reference. The internal silver iodide rich phase can be formed by adding and ripening these fine silver halide grains. In dissolving the fine grains by ripening, the silver halide solvent described above can also be used. These fine grains added need not immediately, completely dissolve to disappear but need only disappear by dissolution when the final grains are completed.

The internal silver iodide rich phase is Located in a region of, when measuring from the center of, e.g., a hexagon formed in a plane by projecting a grain thereon, preferably 5 to less than 100 mol %, more preferably, 20 to less than 95 mol %, and most preferably, 50 to less than 90 mol % with respect to the total silver amount of the grain. The amount of a silver halide which forms the internal silver iodide rich phase is, as a silver amount, preferably 50 mol % or less, and more preferably, 20 mol % or less of the total silver amount of a grain. These values of amounts of the silver iodide rich phase are not those obtained by measuring the halogen composition of the final grain by using various analytical methods but formulated values in the producing of a silver halide emulsion. The internal silver iodide rich phase often disappears from the final grain owing to, e.g., recrystallization, and so all silver amounts described above are related to their formulated values.

It is, therefore, readily possible to observe dislocation lines in the final grains by the above method, but the internal silver iodide rich phase introduced to introduce dislocation lines cannot be observed as a definite phase in many cases because the silver iodide composition in the boundary continuously changes. The halogen compositions in each portion of a grain can be checked by combining X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain).

The silver iodide content of an outer phase covering the internal silver iodide rich phase is lower than that of the silver iodide rich phase, and is preferably 0 to 30 mol %, more preferably, 0 to 20 mol %, and most preferably, 0 to 10 mol % with respect to a silver halide amount contained in the outer phase.

Although the temperature and the pAg, at which the outer phase covering the internal silver iodide rich phase is formed, can take arbitrary values, the temperature is preferably 30° C. to 80° C., and most preferably, 35° C. to 70° C., and the pAg is preferably 6.5 to 11.5. The use of the silver halide solvents described above is sometimes preferable, and the most preferable silver halide solvent is thiocyanate salt.

Another method of introducing dislocation lines to tabular grains is to use an iodide ion releasing agent as described in JP-A-6-11782, the disclosure of which is incorporated herein by reference. This method is also preferably used.

Dislocation lines can also be introduced by appropriately combining this dislocation line introducing method with the above-mentioned dislocation line introducing method.

The variation coefficient of the inter-grain iodide distribution of silver halide grains contained in a light-sensitive material of the present invention is preferably 20% or less, more preferably, 15% or less, and most preferably, 10% or less. If the variation coefficient of the iodide content distribution of each individual silver halide is larger than 20%, no high contrast can be obtained, and a reduction of the sensitivity upon application of a pressure increases.

Any known method can be used as a method of producing silver halide grains contained in a light-sensitive material of the present invention and having a narrow inter-grain iodide distribution. Examples are a method of adding fine grains as disclosed in JP-A-1-183417 and a method which uses an iodide ion releasing agent as disclosed in JP-A-2-68538, the disclosures of which are incorporated herein by reference. These methods can be used alone or in combination.

The variation coefficient of the inter-grain iodide distribution of silver halide grains of the present invention is preferably 20% or less. The most preferred method of monodispersing the inter-grain iodide distribution is a method described in JP-A-3-213845, the disclosure of which is incorporated herein by reference. That is, fine silver halide grains containing 95 mol % or more of silver iodide are formed by mixing an aqueous solution of a water-soluble silver salt and an aqueous solution of a water-soluble halide (containing 95 mol % or more of iodide ions) in a mixer placed outside a reaction vessel, and supplied to the reaction vessel immediately after the formation. In this manner, a monodisperse inter-grain iodide distribution can be achieved. The reaction vessel is a vessel which causes nucleation and/or crystal growth of tabular silver halide grains.

As described in JP-A-3-213845, the disclosure of which is incorporated herein by reference, the following three technologies can be used as a method of adding the silver halide grains prepared in the mixer and as a preparing means used in the method.

(1) After being formed in the mixer, the fine grains are immediately added to the reaction vessel.
(2) Strong and efficient stirring is performed in the mixer.
(3) An aqueous protective colloid solution is poured into the mixer.

The protective colloid used in method (3) above can be singly poured into the mixer or can be poured into the mixer after being contained in an aqueous halogen salt solution or aqueous silver nitrate solution. The concentration of the protective colloid is 1 mass % or more, preferably 2 to 5 mass %. Examples of a polymer compound having a protective colloid function with respect to silver halide grains used in the present invention are a polyacrylamide polymer, an amino polymer, a polymer having a thioether group, polyvinyl alcohol, an acrylic acid polymer, a polymer having hydroxyquinoline, cellulose, starch, acetal, polyvinylpyrrolidone, and a ternary polymer. The use of low-molecular-weight gelatin is preferred. The weight-average molecular weight of this low-molecular-weight gelatin is preferably 30,000 or less, and more preferably, 10,000 or less.

When fine silver halide grains are to be prepared, the grain formation temperature is preferably 35° C. or less, and particularly preferably, 25° C. or less. The temperature of the reaction vessel to which fine silver halide grains are added is 50° C. or more, preferably 60° C. or more, and more preferably, 70° C. or more.

The grain size of a fine silver halide used in the present invention can be directly confirmed by a transmission electron microscope by placing the grain on a mesh. The size of fine grains of the present invention is preferably 0.3 μm or less, more preferably, 0.1 μm or less, and most preferably, 0.01 μm or less. This fine silver halide can be added simultaneously with another halogen ion or silver ion or can be added alone. The mixing amount of the fine silver halide grains is 0.005 to 20 mol %, preferably 0.01 to 10 mol % with respect to a total silver halide.

The silver iodide content of each grain can be measured by analyzing the composition of the grain by using an X-ray microanalyzer. The variation coefficient of an inter-grain iodide distribution is a value defined by $$(\text{standard deviation}/\text{average silver iodide content})\times 100=\text{variation coefficient } (\%)$$

by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [μm] of each grain sometimes have a correlation and sometimes do not. However, Yi and Xi desirably have no correlation. The halogen composition structure of a tabular grain of the present invention can be checked by combining, e.g., X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain). When the silver iodide content is measured in the present invention, the grain surface is a region about 5 nm deep from the surface, and the grain interior is a region except for the surface. The halogen composition of this grain surface can usually be measured by the ESCA method.

In the present invention, regular-crystal grains such as cubic, octahedral, and tetradecahedral grains and irregular twinned-crystal grains can be used in addition to aforementioned tabular grains.

Silver halide emulsions of the present invention are preferably subjected to selenium sensitization or gold sensitization.

As selenium sensitizers usable in the present invention, selenium compounds disclosed in conventionally known patents can be used. Usually, a labile selenium compound and/or a non-labile selenium compound is used by adding it to an emulsion and stirring the emulsion at a high temperature, preferably 40° C. or more for a predetermined period of time. As non-labile selenium compounds, it is preferable to use compounds described in, e.g., Jpn. Pat. Appln. KOKOKU Publication No. (hereinafter referred to as JP-B-)44-15748, JP-B-43-13489, and JP-A's-4-25832 and 4-109240, the disclosures of which are incorporated herein by reference.

Practical examples of a labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis(3-chloro-2,6-dimethoxybenzoyl)selenide), selenophosphates, phosphineselenides, and colloidal metal selenium.

Although preferred examples of a labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of a selenium sensitizer has no important role except the role of carrying selenium and keeping it in a labile state in an emulsion. In the present invention, therefore, labile selenium compounds in this extensive concept are advantageously used.

Examples of a non-labile selenium compound usable in the present invention are compounds described in JP-B's-46-4553, 52-34491, and 52-34492, the disclosures of which are incorporated herein by reference. Practical examples of a non-labile selenium compound are selenious acid, potassium selenocyanide, selenazoles, quaternary ammonium salts of selenazoles, diarylselenide, diaryldiselenide, dialkylselenide, dialkyldiselenide, 2-selenazolidinedione, 2-selenoxazolidinethione, and derivatives of these compounds.

Of these selenium compounds, formulas (A) and (B) presented below are preferred.

(A)

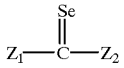

where $Z_1$ and $Z_2$ may be the same or different, and each represents an alkyl group (e.g., methyl, ethyl, t-butyl, adamantyl, or t-octyl), alkenyl group (e.g., vinyl or propenyl) aralkyl group (e.g., benzyl and phenethyl), aryl group (e.g., phenyl, pentafluorophenyl, 4-chlorophenyl, 3-nitrophenyl, 4-octylsulfamoylphenyl, or α-naphthyl), heterocyclic group (e.g., 2-pyridyl, 3-thienyl, 2-furyl, or 2-imidazolyl), —$NR_1(R_2)$, —$OR_3$, or —$SR_4$.

$R_1$, $R_2$, $R_3$, and $R_4$ may be the same or different, and each represents a hydrogen atom, alkyl group, aralkyl group, aryl group, heterocyclic group, or acyl group. Examples of the alkyl group, aralkyl group, aryl group, and heterocyclic group are the same as $Z_1$. Examples of the acyl group are acetyl, propanoyl, benzoyl, heptafluorobutanoyl, difluoroacetyl, 4-nitrobenzoyl, α-naphthoyl, and 4-trifluoromethylbenzoyl.

In formula (A), $Z_1$ preferably represents an alkyl group, aryl group, or —$NR_1(R_2)$, and $Z_2$ preferably represents —$NR_5(R_6)$. $R_1$, $R_2$, $R_5$, and $R_6$ may be the same or different, and each represents a hydrogen atom, alkyl group, aryl group, or acyl group.

Formula (A) more preferably represents N,N-dialkylselenourea, N,N,N'-trialkyl-N'-acylselenourea, tetraalkylselenourea, N,N-dialkyl-arylselenoamide, or N-alkyl-N-aryl-arylselenoamide.

(B)

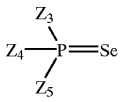

where $Z_3$, $Z_4$, and $Z_5$ may be the same or different, and each represents an alkyl group, alkenyl group, alkinyl group, aralkyl group, aryl group, heterocyclic group, —$OR_7$, —$NR_8(R_9)$, —$SR_{10}$, —$SeR_{11}$, X, or hydrogen atom.

Each of $R_7$, $R_{10}$, and $R_{11}$ independently represents an alkyl group, alkenyl group, alkinyl group, aralkyl group, aryl group, heterocyclic group, hydrogen atom, or cation. Each of $R_8$ and $R_9$ independently represents an alkyl group, alkenyl group, alkinyl group, aralkyl group, aryl group, heterocyclic group, or hydrogen atom. X represents a halogen atom.

In formula (B), an alkyl group, alkenyl group, alkinyl group, and aralkyl group represented by $Z_3$, $Z_4$, $Z_5$, $R_7$, $R_8$, $R_9$, $R_{10}$, and $R_{11}$ represent a straight-chain, branched, or cyclic alkyl group, alkenyl group, alkinyl group, and aralkyl group (e.g., methyl, ethyl, n-propyl, isopropyl, t-butyl, n-butyl, n-octyl, n-decyl, n-hexadecyl, cyclopentyl, cyclohexyl, allyl, 2—butenyl, 3-pentenyl, propargyl, 3-pentinyl, benzyl, or phenethyl).

In formula (B), an aryl group represented by $Z_3$, $Z_4$, $Z_5$, $R_7$, $R_8$, $R_9$, $R_{10}$, and $R_{11}$ represents a monocyclic or condensed-ring aryl group (e.g., phenyl, pentafluorophenyl, 4-chlorophenyl, 3-sulfophenyl, α-naphthyl, or 4-methylphenyl).

In formula (B), a heterocyclic group represented by $Z_3$, $Z_4$, $Z_5$, $R_7$, $R_8$, $R_9$, $R_{10}$, and $R_{11}$ represents a 3- to 10-membered, saturated or unsaturated heterocyclic group containing at least one of a nitrogen atom, oxygen atom, and sulfur atom (e.g., 2-pyridyl, 3-thienyl, 2-furyl, 2-thiazolyl, 2-imidazolyl, or 2-benzimidazolyl). This heterocyclic group may also be a condensed ring.

In formula (B), a cation represented by $R_7$, $R_{10}$, and $R_{11}$ represents an alkali metal atom or ammonium. A halogen atom represented by X represents, e.g., a fluorine atom, chlorine atom, bromine atom, or iodine atom.

In formula (B), each of $Z_3$, $Z_4$, and $Z_5$ preferably independently represents an alkyl group, aryl group, or —$OR_7$, and $R_7$ preferably represents an alkyl group or aryl group.

Formula (B) more preferably represents trialkylphosphineselenide, triarylphosphineselenide, trialkylselenophosphate, or triarylselenophosphate.

Practical examples of compounds represented by formulas (A) and (B) will be presented below. However, the present invention is not limited to these examples.

1.

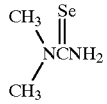

2.

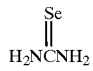

3.

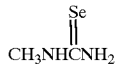

4.

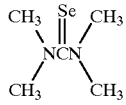

5.

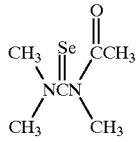

6.

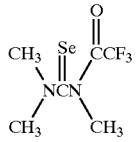

-continued
7.
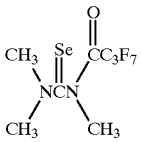
8.
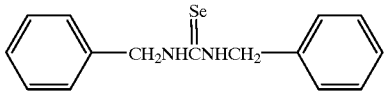
9.
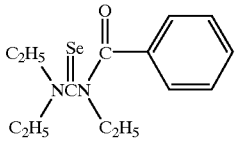
10.
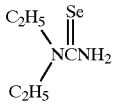
11.
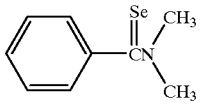
12.
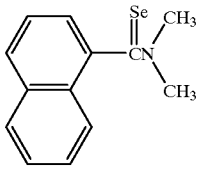
13.
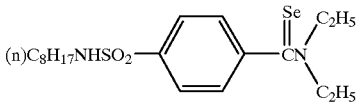
14.
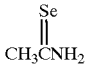
15.
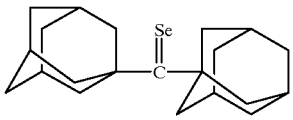
16.
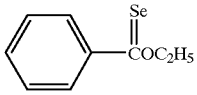
17.
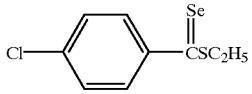
18.
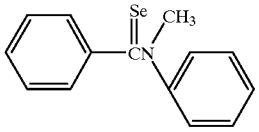
-continued
19.
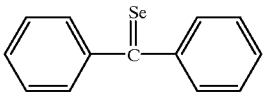
20.
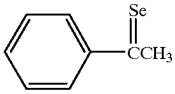
21.
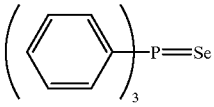
22.
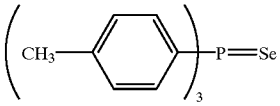
23.
24.
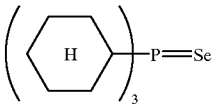
25.
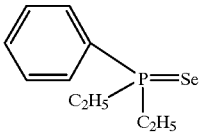
26.
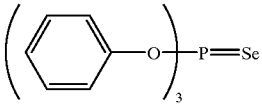
27.
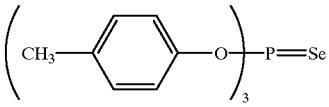
28.
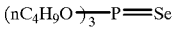
29.
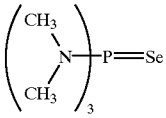
30.
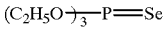
31.
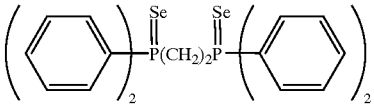
32.
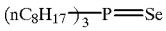
33.
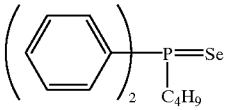

-continued

34.

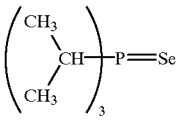

35.

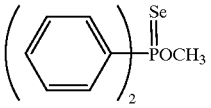

36.

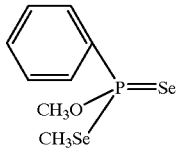

37.

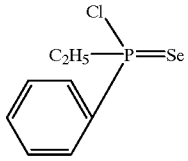

38.

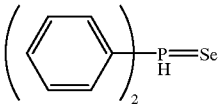

39.

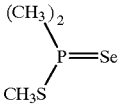

40.

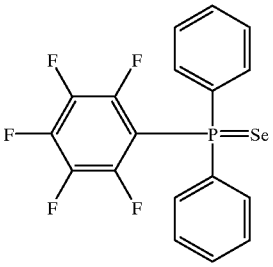

These selenium sensitizers are dissolved in water, an organic solvent such as methanol or ethanol, or a solvent mixture of such organic solvents, and the resultant solution is added during chemical sensitization, preferably before the start of chemical sensitization. A selenium sensitizer to be used is not limited to one type, but two or more types of the selenium sensitizers described above can be used together. Combining a labile selenium compound and a non-labile selenium compound is preferred.

The addition amount of selenium sensitizers usable in the present invention changes in accordance with the activity of each selenium sensitizer used, the type or grain size of a silver halide, and the temperature and time of ripening. The addition amount, however, is preferably $2\times10^{-6}$ to $5\times10^{-6}$ mol per mol of a silver halide. When selenium sensitizers are used, the temperature of chemical sensitization is preferably 40° C. to 80° C. The pAg and pH can take given values. For example, the effect of the present invention can be obtained in a wide pH range of 4 to 9.

Selenium sensitization can be achieved more effectively in the presence of a silver halide solvent.

Examples of a silver halide solvent usable in the present invention are (a) organic thioethers described in U.S. Pat. Nos. 3,271,157, 3,531,289, and 3,574,628, and JP-A's-54-1019 and 54-158917, the disclosures of which are incorporated herein by reference, (b) thiourea derivatives described in JP-A's-53-82408, 55-77737, and 55-2982, the disclosures of which are incorporated herein by reference, (c) a silver halide solvent having a thiocarbonyl group sandwiched between an oxygen or sulfur atom and a nitrogen atom, described in JP-A-53-144319, the disclosure of which is incorporated herein by reference, (d) imidazoles described in JP-A-54-100717, the disclosure of which is incorporated herein by reference, (e) sulfite, and (f) thiocyanate.

Most preferred examples of a silver halide solvent are thiocyanate and tetramethylthiourea. Although the amount of a solvent to be used changes in accordance with its type, a preferred amount is $1\times10^{-4}$ to $1\times10^{-2}$ mol per mol of a silver halide.

A gold sensitizer for use in gold sensitization of the present invention can be any compound having an oxidation number of gold of +1 or +3, and it is possible to use gold compounds normally used as gold sensitizers. Representative examples are chloroaurate, potassium chloroaurate, auricrichloride, potassium auricthiocyanate, potassium iodoaurate, tetracyanoauric acid, ammonium aurothiocyanate, pyridyltrichloro gold, gold sulfide, and gold selenide. Although the addition amount of gold sensitizers changes in accordance with various conditions, the amount is preferably $1\times10^{-7}$ to $5\times10^{-5}$ mol per mol of a silver halide.

Emulsions of the present invention are preferably subjected to sulfur sensitization during chemical sensitization. This sulfur sensitization is commonly performed by adding sulfur sensitizers and stirring the emulsion for a predetermined time at a high temperature, preferably 40° C. or more.

Sulfur sensitizers known to those skilled in the art can be used in sulfur sensitization. Examples are thiosulfate, allylthiocarbamidothiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016, the disclosures of which are incorporated herein by reference. The addition amount of sulfur sensitizers need only be large enough to effectively increase the sensitivity of an emulsion. This amount changes over a wide range in accordance with various conditions, such as the pH, the temperature, and the size of silver halide grains. However, the amount is preferably $1\times10^{-7}$ to $5\times10^{-5}$ mol per mol of a silver halide.

Silver halide emulsions of the present invention can also be subjected to reduction sensitization during grain formation, after grain formation and before or during chemical sensitization, or after chemical sensitization. Reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers is preferred in that the level of reduction sensitization can be finely adjusted.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

It is preferable to use an oxidizer for silver during the process of producing emulsions of the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones.

It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

Photographic emulsions of the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

When a plurality of sensitizing dyes are to be added, these sensitizing dyes can be separately added with predetermined pauses between them or added mixedly, or a portion of one sensitizing dye is previously added and the rest is added together with the other sensitizing dyes. That is, it is possible to select an optimum method in accordance with the types of the chosen sensitizing dyes and with the desired spectral sensitivity.

The addition amount of sensitizing dyes can be $4\times10^{-6}$ to $8\times10^{-3}$ mol per mol of a silver halide. However, for a more favorable silver halide grain size of 0.2 to 1.2 μm, an addition amount of about $5\times10^{-5}$ to $2\times10^{-3}$ mol is more effective.

The twin plane spacing of a silver halide grain of the present invention is preferably 0.017 μm or less, more preferably, 0.007 to 0.017 μm, and most preferably, 0.007 to 0.015 μm.

Fog occurring while a silver halide emulsion of the present invention is aged can be improved by adding and dissolving a previously prepared silver iodobromide emulsion during chemical sensitization. This silver iodobromide emulsion can be added at any timing during chemical sensitization. However, it is preferable to first add and dissolve the silver iodobromide emulsion and then add sensitizing dyes and chemical sensitizers in this order. The silver iodobromide emulsion used has an iodide content lower than the surface iodide content of a host grain, and is preferably a pure silver bromide emulsion. The size of this silver iodobromide emulsion is not limited as long as the emulsion can be completely dissolved. However, the equivalent-sphere diameter is preferably 0.1 μm or less, and more preferably, 0.05 μm or less. Although the addition amount of the silver iodobromide emulsion changes in accordance with a host grain used, the amount is basically preferably 0.005 to 5 mol %, and more preferably, 0.1 to 1 mol % per mol of silver.

Common dopants known to be useful to silver halide emulsions can be used in emulsions used in the present invention. Examples of common dopants are Fe, Co, Ni, Ru, Rh, Pd, Re, Os, Ir, Pt, Au, Hg, Pb, and Tl. In the present invention, a hexacyano iron(II) complex and hexacyanoruthenium complex (to be simply referred to as "metal complexes" hereinafter) are preferably used.

The addition amount of these metal complexes is preferably $10^{-7}$ to $10^{-3}$ mol, and more preferably, $1.0\times10^{-5}$ to $5\times10^{-4}$ mol per mol of a silver halide.

Metal complexes used in the present invention can be added in any stage of the preparation of silver halide grains, i.e., before or after nucleation, growth, physical ripening, or chemical sensitization. Also, metal complexes can be divisionally added a plurality of times. However, 50% or more of the total content of metal complexes contained in a silver halide grain are preferably contained in a layer ½ or less as a silver amount from the outermost surface of the grain. A layer not containing metal complexes can also be formed on the outside, i.e., on the side away from a support, of the layer containing metal complexes herein mentioned.

These metal complexes are preferably contained by dissolving them in water or an appropriate solvent and directly adding the solution to a reaction solution during the formation of silver halide grains, or by forming silver halide grains by adding them to an aqueous silver salt solution, aqueous silver salt solution, or some other solution for forming the grains. Alternatively, these metal complexes are also favorably contained by adding and dissolving fine silver halide grains previously made to contain the metal complexes, and depositing these grains on other silver halide grains.

When these metal complexes are to be added, the hydrogen ion concentration in a reaction solution is such that the pH is preferably 1 to 10, and more preferably, 3 to 7.

In a multilayered silver halide color photographic light-sensitive material, unit light-sensitive layers are generally arranged in the order of red-, green-, and blue-sensitive layers from a support. However, according to the intended use, this order of arrangement can be reversed, or light-sensitive layers sensitive to the same color can sandwich another light-sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit light-sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, the disclosures of which are incorporated herein by reference, layers can be arranged such that a low-speed emulsion layer is formed apart from a support and a high-speed emulsion layer is formed close to the support.

More specifically, layers can be arranged, from the one farthest from a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-B-55-34932, the disclosure of which is incorporated herein by reference, layers can be arranged in the order of a blue-sensitive layer/GH/RH/GL/RL from the one farthest from a support. Furthermore, as described in JP-A's-56-25738 and 62-63936, the disclosures of which are incorporated herein by reference, layers can be arranged in the order of a blue-sensitive layer/GL/RL/GH/RH from the one farthest from a support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. Even when a layer structure is thus constituted by three layers having different sensitivities, these layers can be arranged, in a layer sensitive to one color, in the order of a medium-speed emulsion layer/high-speed emulsion layer/low-speed emulsion layer from the one farthest from a support as described in JP-A-59-202464, the disclosure of which is incorporated herein by reference.

In addition, the order of a high-speed emulsion layer/low-speed emulsion layer/medium-speed emulsion layer or low-speed emulsion layer/medium-speed emulsion layer/high-speed emulsion layer can be used.

Furthermore, the arrangement can be changed as described above even when four or more layers are formed.

As a means for improving the color reproduction, the use of an interlayer inhibiting effect is preferred. It is particularly preferable that a weight-average sensitivity wavelength $\lambda_G$, represented by the following equation (III), of the spectral sensitivity distribution of a green-sensitive silver halide emulsion layer be 520 nm$<\lambda_G\leqq$580 nm, that the weight-average wavelength ($\lambda_{-R}$) of the spectral sensitivity distribution of the interlayer effect, which a red-sensitive silver halide emulsion layer is given from other silver halide emulsion layers within the range of 500 to 600 nm, be 500 nm<$\lambda_{-R}$≦560 nm, and that $\lambda_G-\lambda_{-R}$ be preferably 5 nm or more, more preferably 10 nm or more.

$$\lambda_G = \frac{\int_{500}^{600} \lambda S_G(\lambda)\, d\lambda}{\int_{500}^{600} S_G(\lambda)\, d\lambda} \quad \text{(III)}$$

where SG(λ) is the spectral sensitivity distribution curve of the green-sensitive silver halide emulsion layer, and SG at a specific wavelength λ is represented by the reciprocal of an exposure amount by which a cyan density is fog +0.5 when exposed to the specific wavelength.

To obtain the interlayer effect to a red-sensitive layer as described above in a specific wavelength region, it is preferable to separately form an interlayer effect donor layer containing silver halide grains spectrally sensitized to a predetermined degree. To implement the spectral sensitivity of the present invention, the weight-average sensitivity wavelength of this interlayer effect donor layer is set between 510 and 540 nm.

The weight-average wavelength $\lambda_{-R}$ of the wavelength distribution of the magnitude of the interlayer effect, which a red-sensitive silver halide emulsion layer is given from other silver halide emulsion layers, can be calculated by a method described in JP-A-11-305396, the disclosure of which is incorporated herein by reference.

As a material for imparting the interlayer effect, a compound which releases a development inhibitor or its precursor by reacting with the oxidized form of a developing agent produced by development is used. Examples are a DIR (development inhibitor releasing) coupler, DIR-hydroquinone, and a coupler which releases DIR-hydroquinone or its precursor. For a development inhibitor having high diffusivity, the development inhibiting effect can be obtained regardless of the position of the donor layer in a multilayered interlayer arrangement. However, a development inhibiting effect in an unintended direction also occurs. To correct this effect, therefore, it is preferable to make the donor layer generate a color (e.g., to make the donor layer generate the same color as a layer which undergoes the influence of the undesired development inhibiting effect). Generation of magenta is preferable to obtain the spectral sensitivity of the present invention.

The size and shape of silver halide grains to be used in the layer having the interlayer effect on red-sensitive layers are not particularly restricted. It is, however, favorable to use so-called tabular grains having a high aspect ratio, a monodisperse emulsion which is uniform in grain size, or silver iodobromide grains having a layered structure of iodide. In addition, to enlarge the exposure latitude, it is preferable to mix two or more types of emulsions different in grain size.

Although the donor layer which donates the interlayer effect to a red-sensitive layer can be formed in any position on a support, it is preferable to form this layer closer to the support than a blue-sensitive layer and farther from the support than a green-sensitive layer. It is more preferable that the donor layer be located closer to the support than a yellow filter layer.

It is further preferable that the donor layer which donates the interlayer effect to a red-sensitive layer be located closer to a support than a green-sensitive layer and farther from the support than the red-sensitive layer. It is most preferable that the donor layer be located adjacent to the side of a green-sensitive layer close to a support. "Adjacent" means that there is no interlayer or the like in between.

The layer which donates the interlayer effect to a red-sensitive layer can include a plurality of layers. In that case, these layers can be either adjacent to or separated from each other.

Solid disperse dyes described in JP-A-11-305396, the disclosure of which is incorporated herein by reference can be used in the present invention.

An emulsion used in a light-sensitive material of the present invention can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical sensitization, and spectral sensitization before being used. Additives for use in these steps are described in Research Disclosure (RD) Nos. 17643, 18716, and 307105, and the corresponding portions are summarized in a table to be presented later.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average grain size of these fogged silver halide grains is preferably 0.01 to 0.75 μm, and most preferably, 0.05 to 0.6 μm. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 2 μm.

The fine-grain silver halide can be prepared following the same procedures as for a common light-sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

Although the several different additives described above are used in a light-sensitive material according to this technique, a variety of other additives can also be used in accordance with the intended use.

These additives are described in more detail in Research Disclosures Item 17643 (December, 1978), Item 18716 (November, 1979), and Item 308119 (December, 1989), the disclosures of which are incorporated herein by reference. The corresponding portions are summarized in a table below.

| Additives | RD17643 | RD18716 |
|---|---|---|
| 1. Chemical sensitizers | page 23 | page 648, right column |
| 2. Sensitivity increasing agents | | do |
| 3. Spectral sensitizers, super sensitizers | page 23–24 | page 648, right column to page 649, right column |
| 4. Brighteners | page 24 | |
| 5. Antifoggants and stabilizers | pages 24–25 | page 649, right column |
| 6. Light absorbent, filter dye, ultra-violet absorbents | page 25–26 | page 649, right column to page 650, left column |
| 7. Stain preventing agents | page 25, right column | page 650, left to right columns |
| 8. Dye image stabilizer | page 25 | |
| 9. Hardening agents | page 26 | page 651, left column |
| 10. Binder | page 26 | do |
| 11. Plasticizers, lubricants | page 27 | page 650, right column |
| 12. Coating aids, surface active agents | pages 26–27 | do |
| 13. Antistatic agents | page 27 | do |
| 14. Matting agent | | |

| Additives | RD308119 |
|---|---|
| 1. Chemical Sensitizers | page 996 |
| 2. Sensitivity increasing agents | |
| 3. Spectral sensitizers, super sensitizers | page 996, right column to page 998, right column |
| 4. Brighteners | page 998, right column |
| 5. Antifoggants and stabilizers | page 998, right column to page 1,000, right column |
| 6. Light absorbent, filter dye, ultra-violet absorbents | page 1,003, left column to page 1,003, right column |
| 7. Stain preventing agents | page 1,002, right column |
| 8. Dye image stabilizer | page 1,002, right column |
| 9. Hardening agents | page 1,004, right column to page 1,005, left column |
| 10. Binder | page 1,003, right column to page 1,004, right column |
| 11. Plasticizers, lubricants | page 1,006, left to right columns |
| 12. Coating aids, surface active agents | page 1,005, left column to page 1,006, left column |
| 13. Antistatic agents | page 1,006, right column to page 1,007, left column |
| 14. Matting agent | page 1,008, left column to page 1,009, left column. |

Techniques such as a layer arrangement technique, silver halide emulsions, dye forming couplers, functional couplers such as DIR couplers, various additives, and development usable in emulsions of the present invention and light-sensitive materials using the emulsions are described in European Patent No. 0565096A1 (laid open in Oct. 13, 1993) and the patents cited in it, the disclosures of which are incorporated herein by reference. The individual items and the corresponding portions are enumerated below.

1. Layer arrangements: page 61, lines 23–35, page 61, line 41-page 62, line 14
2. Interlayers: page 61, lines 36–40
3. Interlayer effect donor layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54-page 63, line 5
12. Physical ripening and chemical sensitization of emulsions: page 63, lines 6–9
13. Use of emulsion mixtures: page 63, lines 10–13
14. Fogged emulsions: page 63, lines 14–31
15. Non-light-sensitive emulsions: page 63, lines 32–43
16. Silver coating amount: page 63, lines 49–50
17. Formaldehyde scavengers: page 64, lines 54–57
18. Mercapto-based antifoggants: page 65, lines 1–2
19. Agents releasing, e.g., fogging agent: page 65, lines 3–7
20. Dyes: page 65, lines 7–10
21. General color couplers: page 65, lines 11–13
22. Yellow, magenta, and cyan couplers: page 65, lines 14–25
23. Polymer couplers: page 65, lines 26–28
24. Diffusing dye forming couplers: page 65, lines 29–31
25. Colored couplers: page 65, lines 32–38
26. General functional couplers: page 65, lines 39–44
27. Bleaching accelerator release couplers: page 65, lines 45–48
28. Development accelerator release couplers: page 65, lines 49–53
29. Other DIR couplers: page 65, line 54-page 66, line 4
30. Coupler diffusing methods: page 66, lines 5–28
31. Antiseptic agents and mildewproofing agents: page 66, lines 29–33
32. Types of light-sensitive materials: page 66, lines 34–36

33. Light-sensitive layer film thickness and swell speed: page 66, line 40-page 67, line 1
34. Back layers: page 67, lines 3–8
35. General development processing: page 67, lines 9–11
36. Developers and developing agents: page 67, lines 12–30
37. Developer additives: page 67, lines 31–44
38. Reversal processing: page 67, lines 45–56
39. Processing solution aperture ratio: page 67, line 57-page 68, line 12
40. Development time: page 68, lines 13–15
41. Bleach-fix, bleaching, and fixing: page 68, line 16-page 69, line 31
42. Automatic processor: page 69, lines 32–40
43. Washing, rinsing, and stabilization: page 69, line 41-page 70, line 18
44. Replenishment and reuse of processing solutions: page 70, lines 19–23
45. Incorporation of developing agent into light-sensitive material: page 70, lines 24–33
46. Development temperature: page 70, lines 34–38
47. Application to film with lens: page 70, lines 39–41

It is also possible to preferably use a bleaching solution described in European Patent No. 602600, the disclosure of which is incorporated herein by reference, which contains 2-pyridinecarboxylic acid or 2,6-pyridinedicarboxylic acid, ferric salt such as ferric nitrate, and persulfate. When this bleaching solution is to be used, it is preferable to interpose a stop step and a washing step between the color development step and the bleaching step and to use organic acid such as acetic acid, succinic acid, or maleic acid as the stop bath. Furthermore, for the purposes of pH adjustment and bleaching fog, the bleaching solution preferably contains 0.1 to 2 mols/litter (litter will be referred to as "L" hereinafter) of organic acid such as acetic acid, succinic acid, maleic acid, glutaric acid, or adipic acid.

A magnetic recording layer preferably used in the present invention will be described below.

This magnetic recording layer is formed by coating the surface of a support with an aqueous or organic solvent-based coating solution which is prepared by dispersing magnetic grains in a binder.

As the magnetic grains used in the present invention, it is possible to use, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferred. The grain can take the shape of any of, e.g., a needle, rice grain, sphere, cube, and plate. The specific area is preferably 20 $m^2/g$ or more, and more preferably, 30 $m^2/g$ or more as $S_{BET}$.

The saturation magnetization ($\sigma s$) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6–161032, the disclosure of which is incorporated herein by reference. A ferromagnetic grain whose surface is coated with an inorganic or organic substance described in JP-A-4–259911 or JP-A-5–81652, the disclosures of which are incorporated herein by reference, can also be used.

As a binder used in the magnetic grains, it is possible to use a thermoplastic resin, thermosetting resin, radiation-curing resin, reactive resin, acidic, alkaline, or biodegradable polymer, natural polymer (e.g., a cellulose derivative and sugar derivative), and their mixtures. These examples are described in JP-A-4–219569, the disclosure of which is incorporated herein by reference. The Tg of the resin is preferably −40° C. to 300° C., and its weight average molecular weight is preferably 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferred. Cellulosedi(tri)acetate is particularly preferred. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6–59357, the disclosure of which is incorporated herein by reference.

As a method of dispersing the magnetic substance in the binder, as described in JP-A-6–35092, the disclosure of which is incorporated herein by reference, a kneader, pin type mill, and annular mill are preferably used singly or together. Dispersants described in JP-A-5–088283, the disclosure of which is incorporated herein by reference, and other known dispersants can be used. The thickness of the magnetic recording layer is 0.1 to 10 $\mu$m, preferably 0.2 to 5 $\mu$m, and more preferably, 0.3 to 3 $\mu$m. The weight ratio of the magnetic grains to the binder is preferably 0.5:100 to 60:100, and more preferably, 1:100 to 30:100. The coating amount of the magnetic grains is 0.005 to 3 $g/m^2$, preferably 0.01 to 2 $g/m^2$, and more preferably, 0.02 to 0.5 $g/m^2$. The transmission yellow density of the magnetic recording layer is preferably 0.01 to 0.50, more preferably, 0.03 to 0.20, and most preferably, 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5–341436, the disclosure of which is incorporated herein by reference is preferred.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferred. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in U.S. Pat. No. 5,336,589, U.S. 5,250,404, U.S. 5,229,259, U.S. 5,215,874, and EP 466,130, the disclosures of which are incorporated herein by reference.

A polyester support used in the present invention will be described below. Details of the polyester support and light-sensitive materials, processing, cartridges, and examples (to be described later) are described in Journal of Technical Disclosure No. 94–6023 (JIII; Mar. 15, 1994), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred. Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg −20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or is while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/m$^2$, and particularly preferably, 10 to 350 mg/m$^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1–312537 and JP-A-1–312538, the disclosures of which are incorporated herein by reference. It is particularly preferable that the resistance be $10^{12}$ Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. No. 4,834,306 and U.S. 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic light-sensitive material of the present invention is also suitably used as a negative film for Advanced Photo System (to be referred to as APS hereinafter). Examples are the NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series (e.g., the EPION 300Z).

A color photosensitive film of the present invention is also suited as a film with lens such as the Fuji Film FUJICOLOR UTSURUNDESU SUPER SLIM or the UTSURUNDESU ACE 800.

A photographed film is printed through the following steps in a mini-lab system.

(1) Reception (an exposed cartridge film is received from a customer)

(2) Detaching step (the film is transferred from the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferred. Examples of a film processor for the MINI-LAB CHAMPION are the FP922AL, FP562B, FP562B,AL, FP362B, and FP362B,AL, and recommended processing chemicals are the FUJICOLOR JUST-IT CN-16L and CN-16Q. Examples of a printer processor are the PP3008AR, PP3008A, PP1828AR, PP1828A, PP1258AR, PP1258A, PP72BAR, and PP728A, and a recommended processing chemicals are the FUJICOLOR JUST-IT CP-47L and CP-40FAII. In the FRONTIER system, the SP-1000 scanner & image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy disk, Zip disk, CR-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

Examples of the present invention will be described below. However, the present invention is not limited to these examples.

EXAMPLE 1

Silver halide emulsions Em-A to Em-O were prepared by the following producing methods.

(Preparation of Em-A)

1,200 ml of an aqueous solution containing 1.0 g of low-molecular-weight gelatin having a weight-average molecular weight of 15,000 and 1.0 g of KBr were held at 35° C. and intensely stirred. 30 ml of an aqueous solution containing 1.9 g of $AgNO_3$ and 30 ml of an aqueous solution containing 1.5 g of KBr and 0.7 g of low-molecular-weight gelatin having a weight-average molecular weight of 15,000 were added over 30 sec by the double-jet method to perform nucleation. During this nucleation, the excess KBr concentration was held constant. 6 g of KBr were added, and the temperature was raised to perform ripening. After the ripening, 35 g of succinated gelatin were added, and the pH was adjusted to 5.5. 150 ml of an aqueous solution containing 30 g of $AgNO_3$ and an aqueous KBr solution were added over 16 min by the double-jet method. During the addition, the silver potential was held at −25 mV with respect to a saturated calomel electrode. Furthermore, an aqueous solution containing 110 g of $AgNO_3$ and an aqueous KBr solution were added over 15 min at accelerated flow rates such that the final flow rates were 1.2 times the initial flow rates. At the same time, an AgI fine-grain emulsion having a size of 0.03 $\mu$m was added at an accelerated flow rate such that the silver iodide content was 3.8%, and the silver potential was held at −25 mV. 132 ml of an aqueous solution containing 35 g of $AgNO_3$ and an aqueous KBr solution were added over 7 min by the double-jet method. The addition of the KBr solution was so adjusted that the potential at the end of the addition was −20 mV.

After the temperature was set at 40° C., a compound 1 presented below was added in an amount of 5.6 g as a KI amount, and 64 cc of an aqueous 0.8 M sodium sulfite solution were added. An aqueous NaOH solution was added to raise the pH to 9.0, and this pH value was held for 4 min to abruptly produce iodide ions. After that, the pH was returned to 5.5. The temperature was returned to 55° C., 1 mg of sodium benzenethiosulfonate was added, and 13 g of lime-processed gelatin having a calcium concentration of 1 ppm were added. After the addition, 250 ml of an aqueous solution containing 70 g of $AgNO_3$ and an aqueous KBr solution were added over 20 min while the potential was held at 60 mV. During the addition, $1.0\times10^{-5}$ mol of yellow prussiate of potash was added per mol of silver. After the emulsion was washed with water, 80 g of lime-processed gelatin having a calcium concentration of 1 ppm were added, and the pH and pAg were adjusted to 5.8 and 8.7, respectively, at 40° C.

Compound 1

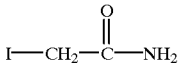

The calcium, magnesium, and strontium contents of the above emulsion were measured by ICP emission spectrochemical analysis and found to be 15, 2, and 1 ppm, respectively.

The above emulsion was heated to 56° C. First, a pure AgBr fine-grain emulsion having a size of 0.05 $\mu$m was added in an amount of 1 g as an Ag amount to form shells. Subsequently, sensitizing dyes 1, 2, and 3 in the form of fine solid dispersions were added in amounts of $5.85\times10^{-4}$, $3.06\times10^{-4}$, and $9.00\times10^{-6}$ mol, respectively, per mol of silver. The fine solid dispersions of the sensitizing dyes 1, 2, and 3 were prepared as follows. As shown by the formation conditions in Table 2, after inorganic salt was dissolved in ion-exchanged water, the sensitizing dyes were added and dispersed for 20 min by using a dissolver blade at 60° C., thereby forming fine solid dispersions of the sensitizing dyes 1, 2, and 3. When the adsorption of the sensitizing dyes reached 90% of an adsorption amount in an equilibrium state, calcium nitrate was added such that the calcium concentration was 250 ppm. The sensitizing dye adsorption amount was obtained by separation into a solid layer and liquid layer by centrifugal precipitation and measuring a difference between the initially added sensitizing dye amount and the sensitizing dye amount in the supernatant liquid. After the addition of calcium nitrate, the emulsion was optimally, chemically sensitized by adding potassium thiocyanate, chloroauric acid, sodium thiosulfate, N,N-dimethylselenourea, and a compound 4. N,N-dimethylselenourea was added in an amount of $3.40\times10^{-6}$ mol per mol of silver. At the end of this chemical sensitization, compounds 2 and 3 were added to prepare Em-A.

TABLE 2

Sensitizing dye 1

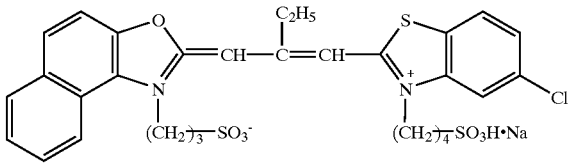

Sensitizing dye 2

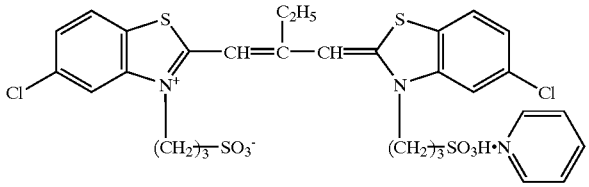

TABLE 2-continued

Sensitizing dye 3

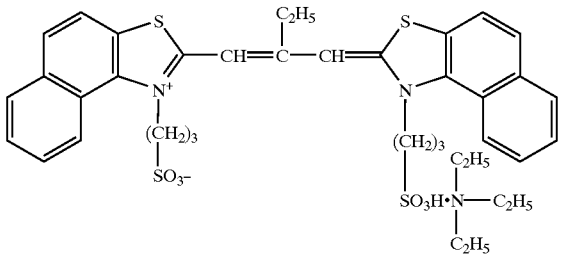

Compound 2

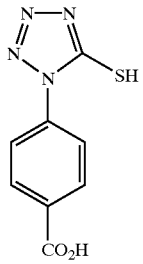

Compound 3

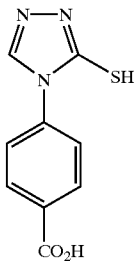

Compound 4

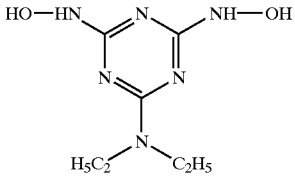

| Sensitizing dye | Sensitizing dye amount (parts by weight) | $NaNO_3/Na_2SO_4$ (parts by weight) | Water (parts by weight) | Dispersion time | Dispersion temperature |
|---|---|---|---|---|---|
| 1 | 3 | 0.8/3.2 | 43 | 20 minutes | 60° C. |
| 2/3 | 4/0.12 | 0.6/2.4 | 42.8 | 20 minutes | 60° C. |

(Preparation of Em-B)

Em-B was prepared following the same procedures as for Em-A except that the KBr amount added after nucleation was changed to 5 g, the addition amount of the compound 1 was changed to 8.0 g as a KI amount, the amounts of the sensitizing dyes 1, 2, and 3 added before chemical sensitization were changed to $6.50\times10^{-4}$, $3.40\times10^{-4}$, and $1.00\times10^{-5}$ mol. respectively, and the amount of N,N-dimethylselenourea added during chemical sensitization was changed to $4.00\times10^{-6}$ mol.

(Preparation of Em-C)

Em-C was prepared following the same procedures as for Em-A except that the KBr amount added after nucleation was changed to 1.5 g, the addition amount of the compound 1 was changed to 7.1 g as a KI amount, the amounts of the sensitizing dyes 1, 2, and 3 added before chemical sensitization were changed to $7.80\times10^{-4}$, $4.08\times10^{-4}$, and $1.20\times10^{-5}$ mol, respectively, and the amount of N,N-dimethylselenourea added during chemical sensitization was changed to $5.00\times10^{-6}$ mol.

(Preparation of Em-E)

Em-E was prepared following the same procedures as for Em-A except that the addition amount of the compound 1 was changed to 8.0 g as a KI amount, the sensitizing dyes added before chemical sensitization were changed to sensitizing dyes 4, 5, and 6, and their addition amounts were set to $7.73\times10^{-4}$, $1.65\times10^{-4}$, and $6.20\times10^{-5}$ mol, respectively.

Sensitizing dye 4

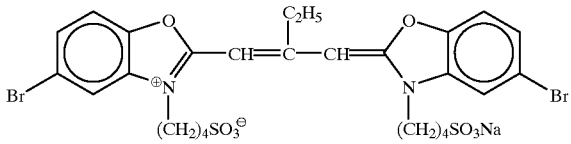

Sensitizing dye 5

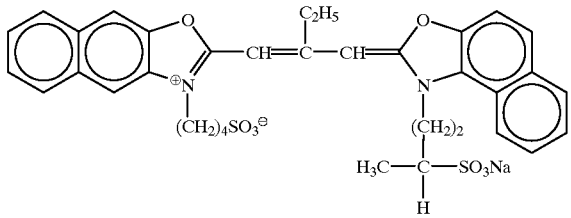

Sensitizing dye 6

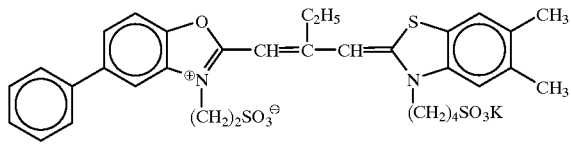

(Preparation of Em-F)

Em-F was prepared following the same procedures as for Em-B except that the addition amount of the compound 1 was changed to 9.2 g as a KI amount, the sensitizing dyes added before chemical sensitization were changed to the sensitizing dyes 4, 5, and 6, and their addition amounts were set to $8.50\times10^{-4}$, $1.82\times10^{-4}$, and $6.82\times10^{-5}$ mol, respectively.

(Preparation of Em-G)

Em-G was prepared following the same procedures as for Em-C except that the sensitizing dyes added before chemical sensitization were changed to the sensitizing dyes 4, 5, and 6, and their addition amounts were set to $1.00\times10^{-3}$, $2.15\times10^{-4}$ and $8.06\times10^{-5}$ mol, respectively.

(Preparation of Em-J)

Em-J was prepared following the same procedures as for Em-B except that the sensitizing dyes added before chemical sensitization were changed to sensitizing dyes 7 and 8, and their addition amounts were set to $7.65\times10^{-4}$ and $2.74\times10^{-4}$ mol, respectively.

Sensitizing dye 7

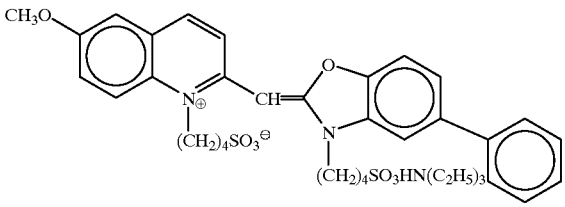

Sensitizing dye 8

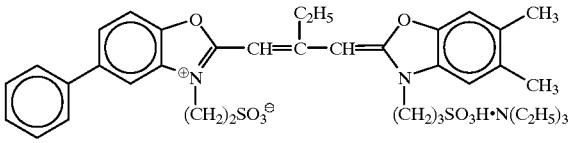

(Preparation of Em-L)

(Preparation of Silver Bromide Seed Crystal Emulsion)

A silver bromide tabular emulsion having an average equivalent-sphere diameter of 0.6 μm and an average aspect ratio of 9.0 and containing 1.16 mol of silver and 66 g of gelatin per kg of the emulsion was prepared.

(Growth process 1)

0.3 g of modified silicone oil were added to 1,250 g of an aqueous solution containing 1.2 g of potassium bromide and succinated gelation at a succination ratio of 98%. After the above silver bromide tabular emulsion containing 0.086 mol of silver was added, the resultant material was stirred at 78° C. An aqueous solution containing 18.1 g of silver nitrate and the above-mentioned 0.037-μm fine silver iodide grains were added such that the content was 5.4 mol with respect to silver. At the same time, an aqueous potassium bromide solution was added by the double-jet method so that the pAg was 8.1.

(Growth process 2)

After 2 mg of sodium benzenethiosulfonate were added, 0.45 g of 3,5-disulfocatechol 2 sodium salt and 2.5 mg of thiourea dioxide were added.

In addition, an aqueous solution containing 95.7 g of silver nitrate and an aqueous potassium bromide solution were added over 66 min at accelerated flow rates by the double-jet method. At the same time, the aforementioned 0.037-μm fine silver iodide grains were added such that the content was 7.0 mol with respect to silver. During the addition, the amount of the potassium bromide added by the double-jet method was so adjusted that the pAg was 8.1. After the addition, 2 mg of sodium benzenethiosulfonate were added.

(Growth process 3)

An aqueous solution containing 19.5 g of silver nitrate and an aqueous potassium bromide solution were added over 16 min by the double-jet method. During the addition, the amount of the potassium bromide solution was so adjusted that the pAg was 7.9.

(Sparingly Soluble Silver Halide Emulsion Addition 4)

After the above host grains were adjusted by an aqueous potassium bromide solution so that the pAg was 9.3, 25 g of the 0.037-μm silver iodide fine-grain emulsion were abruptly added within 20 sec.

(Outermost Shell Layer Formation 5)

Furthermore, an aqueous solution containing 34.9 g of silver nitrate was added over 22 min.

This emulsion contained tabular grains having an average aspect ratio of 9.8 and an average equivalent-sphere diameter of 1.4 μm. The average silver iodide content was 5.5 mol.

(Chemical Sensitization)

After the emulsion was washed with water, succinated gelatin at a succination ratio of 98% and calcium nitrate were added, and the pH and pAg were adjusted to 5.8 and 8.7, respectively, at 40° C. The temperature was raised to 60° C., and $5\times10^{-3}$ mol of a 0.07-μm silver bromide fine-grain emulsion was added. 20 min after that, sensitizing dyes 9, 10, and 11 were added. After that, the emulsion was optimally, chemically sensitized by adding potassium thiocyanate, chloroauric acid, sodium thiosulfate, N,N-dimethylselenourea, and the compound 4. The compound 3 was added 20 min before the end of the chemical sensitization, and a compound 5 was added at the end of the chemical sensitization. "Optimally, chemically sensitized" means that the addition amounts of each sensitizing dye and each compound were selected from $10^{-1}$ to $10^{-8}$ mol per mol of a silver halide such that the sensitivity was highest when the emulsion was exposed by 1/100.

Sensitizing dye 9

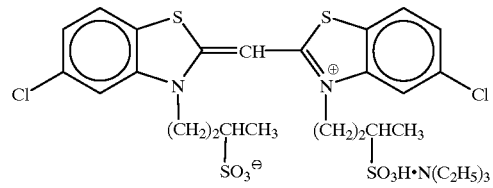

Sensitizing dye 10

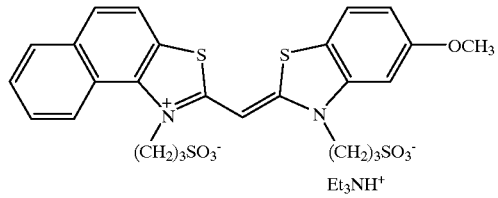

Sensitizing dye 11

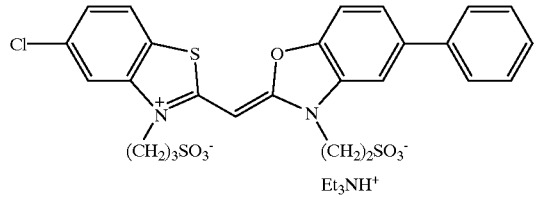

-continued

Compound 4

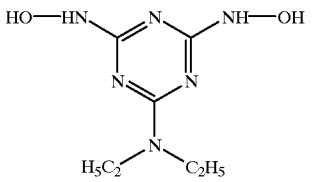

Compound 5

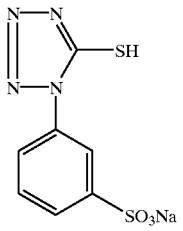

(Preparation of Em-O)

An aqueous gelatin solution (1,250 ml of distilled water, 48 g of deionized gelatin, and 0.75 g of KBr) was placed in a reaction vessel including a stirrer, and the temperature of the solution was held at 70° C. 276 ml of an aqueous $AgNO_3$ solution (containing 12.0 g of $AgNO_3$) and an equimolar concentration of an aqueous KBr solution were added to the above solution over 7 min by the controlled double-jet method while the pAg was held at 7.26. The temperature was lowered to 68° C., and 7.6 ml of thiourea dioxide.(0.05 wt %) were added.

Subsequently, 592.9 ml of an aqueous $AgNO_3$ solution (containing 108.0 g of $AgNO_3$ and an equimolar concentration of an aqueous KBr/KI solution mixture (2.0 mol % of KI) were added over 18 min 30 sec by the controlled double-jet method while the pAg was held at 7.30. Also, 18.0 ml of thiosulfonic acid (0.1 wt %) were added 5 min before the end of the addition.

The obtained grains were cubic grains having an equivalent-sphere diameter of 0.19 μm and an average silver iodide content of 1.8 mol %.

Em-O was redispersed by performing desalting and washing with water by a common flocculation method. After that, the pH and pAg were adjusted to 6.2 and 7.6, respectively, at 40° C.

Em-O was then spectrally and chemically sensitized as follows.

First, each of sensitizing dyes 10, 11, and 12 was added in an amount of $3.37\times10^{-4}$ mol/mol per mol of silver, and $8.82\times10^{-4}$, $8.83\times10^{-5}$, $5.95\times10^{-4}$, and $3.07\times10^{-5}$ mol/mol of KBr, sodium thiosulfate, an aqueous potassium thiocyanate solution, and potassium chloroaurate, respectively, were added to perform ripening at 68° C. Note that the ripening time was so controlled that the sensitivity of 1/100-sec exposure was highest.

Sensitizing dye 12

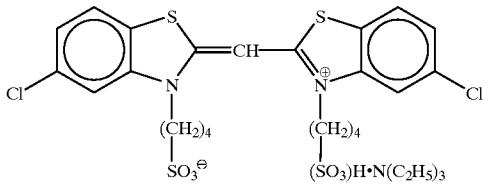

(Em-D, H, I, K, M, and N)

Tabular grains were prepared by using low-molecular-weight gelatin in accordance with examples in JP-A-1–158426, the disclosure of which is incorporated herein by reference. Also, in accordance with examples in JP-A-3–237450, the disclosure of which is incorporated herein by reference, gold sensitization, sulfur sensitization, and selenium sensitization were performed in the presence of spectral sensitizing dyes described in Table 3 and sodium thiosulfate. Emulsions D, H, I, and K contained optimum amounts of Ir and Fe. Emulsions M and N were subjected to reduction sensitization during grain preparation by using thiourea dioxide and thiosulfonic acid, in accordance with examples in JP-A-2–191938, the disclosure of which is incorporated herein by reference.

TABLE 3

| Emulsion name | Sensitizing dye | Addition amount (mol/mol silver) |
|---|---|---|
| Em-D | Sensitizing dye 1 | $5.44\times10^{-4}$ |
| | Sensitizing dye 2 | $2.35\times10^{-4}$ |
| | Sensitizing dye 3 | $7.26\times10^{-6}$ |
| Em-H | Sensitizing dye 8 | $6.52\times10^{-4}$ |
| | Sensitizing dye 13 | $1.35\times10^{-4}$ |
| | Sensitizing dye 6 | $2.48\times10^{-5}$ |
| Em-I | Sensitizing dye 8 | $6.09\times10^{-4}$ |
| | Sensitizing dye 13 | $1.26\times10^{-4}$ |
| | Sensitizing dye 6 | $2.32\times10^{-5}$ |
| Em-K | Sensitizing dye 7 | $6.27\times10^{-4}$ |
| | Sensitizing dye 8 | $2.24\times10^{-4}$ |
| Em-M | Sensitizing dye 9 | $2.43\times10^{-4}$ |
| | Sensitizing dye 10 | $2.43\times10^{-4}$ |
| | Sensitizing dye 11 | $2.43\times10^{-4}$ |
| Em-N | Sensitizing dye 9 | $3.28\times10^{-4}$ |
| | Sensitizing dye 10 | $3.28\times10^{-4}$ |
| | Sensitizing dye 11 | $3.28\times10^{-4}$ |

Sensitizing dye 13

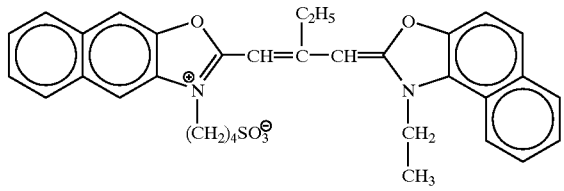

TABLE 4

| Emulsion name | Average iodide (mol %) | Equivalent-sphere diameter (μm) | Average aspect ratio | Equivalent-circle diameter (μm) | Grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

In Table 4, dislocation lines as described in JP-A-3–237450 were observed in tabular grains when a high-voltage electron microscope was used.

1) Support

A support used in this example was formed by the following method.

(i) First layer and undercoat layer

Glow discharge was performed on the two surfaces of a 90-μm thick polyethylenenaphthalate support at a processing ambient pressure of 26.7 Pa, an $H_2O$ partial pressure in the ambient gas of 75%, a discharge frequency of 30 kHz, an output of 2,500 W, and a processing intensity of 0.5 kV·A·min/$m^2$. One surface (back surface) of this support was coated with 5 mL/$m^2$ of a coating solution having the following composition as a first layer by using a bar coating method described in JP-B-58–4589, the disclosure of which is incorporated herein by reference.

| | |
|---|---|
| Conductive fine-grain dispersion (a water dispersion having an $SnO_2/Sb_2O_5$ grain concentration of 10%, a secondary aggregate having a primary grain size of 0.0005 μm and an average grain size of 0.05 μm) | 50 parts by weight |
| Gelatin | 0.5 parts by weight |
| Water | 49 parts by weight |
| Polyglycerolpolyglycidyl ether | 0.16 parts by weight |
| Poly(polymerization degree 20) oxyethylenesorbitanmonolaurate | 0.1 part by weight |

In addition, after the first layer was formed by coating, the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 mL/$m^2$ of a coating solution having the following composition as an undercoat layer for emulsions, by using a bar coating method.

| | |
|---|---|
| Gelatin | 1.01 parts by weight |
| Salicylic acid | 0.30 parts by weight |
| Resorcin | 0.40 parts by weight |
| Poly(polymerization degree 10) oxyethylenenonylphenyl ether | 0.11 parts by weight |
| Water | 3.53 parts by weight |
| Methanol | 84.57 parts by weight |
| n-Propanol | 10.08 parts by weight |

Furthermore, second and third layers to be described later were formed in this order on the first layer by coating. Subsequently, the opposite side (emulsion surface side) was coated with multiple layers of a color negative light-sensitive material having a composition to be described later, thereby making a transparent magnetic recording medium having silver halide emulsion layers.

(ii) Second Layer (Transparent Magnetic Recording Layer)

(1) Dispersion of Magnetic Substance 1,100 parts by weight of a Co-deposited γ-$Fe_2O_3$ magnetic substance (average long axis length: 0.25 μm, SBET: 39 $m^2$/g, Hc: 831 Oe, σs: 77.1 $Am^2$/kg, σr: 37.4 $Am^2$/kg), 220 parts by weight of water, and 165 parts by weight of a silane coupling agent [3-(poly(polymerization degree 10)oxyethynyl)oxypropyl trimethoxysilane] were added and well kneaded for 3 hr by an open kneader. This coarsely dispersed viscous solution was dried at 70° C. for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethylketone | 136.3 g |
| Cyclohexanone | 136.3 g |

The resultant material was finely dispersed at 2,000 rpm for 4 hr by the following formulation by using a sand mill (¼ G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(2) Formation of Magnetic Substance-containing intermediate solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An α-alumina polishing material dispersion of the present invention was formed by the following formulation.

(a) Sumicorundum AA-1.5 (average primary grain size 1.5 μm, specific surface area 1.3 $m^2$/g)

Formation of grain dispersion

| | |
|---|---|
| Sumikorandom AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/cyclohexanone = 1/1) | 227.52 g |

The above formulation was finely dispersed at 800 rpm for 4 hr by using a ceramic-coated sand mill (¼ G sand mill). Zirconia beads 1 mm in diameter were used as media.

(b) Colloidal silica grain dispersion (fine grains)

"MEK-ST" manufactured by Nissan Chemical Industries, Ltd. was used.

"MEK-ST" was a colloidal silica dispersion containing methylethylketone as a dispersion medium and having an average primary grain size of 0.015 μm. The solid content is 30%.

(3) Formation of second layer coating solution

| | |
|---|---|
| Above-mentioned magnetic substance-containing intermediate solution | 19,053 g |
| Diacetylcellulose solution (solid content 4.5%, solvent: methylethylketone/cyclohexanone = 1/1) | 264 g |

-continued

| | |
|---|---|
| Colloidal silicon dispersion "MEK-ST" [dispersion b] (solid content 30%) | 128 g |
| AA-1.5 dispersion [dispersion a] | 12 g |
| Millionate MR-400 (manufactured by Nippon Polyurethane K.K.) diluted solution (solid content 20%, diluent solvent: methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 mL/m$^2$ by using a wire bar. The solution was dried at 110° C. The thickness of the dried magnetic layer was 1.0 $\mu$m.

(iii) Third layer (higher fatty acid ester slipping agent-containing layer)

(1) Formation of undiluted dispersion

A solution A presented below was dissolved at 100° C. and added to a solution B. The resultant solution mixture was dispersed by a high-pressure homogenizer to form an undiluted dispersion of a slipping agent.

| | |
|---|---|
| Solution A | |
| Compound below $C_6H_{13}CH(OH)(CH_2)_{10}COOC_{50}H_{101}$ | 399 parts by weight |
| Compound below $n\text{-}C_{50}H_{101}O(CH_2CH_2O)_{16}H$ | 177 parts by weight |
| Cyclohexanone | 830 parts by weight |
| Solution B | |
| Cyclohexanone | 8,600 parts by weight |

(2) Formation of spherical inorganic grain dispersion

A spherical inorganic grain dispersion [c1] was formed by the following formulation.

| | |
|---|---|
| Isopropyl alcohol | 93.54 parts by weight |
| Silane coupling agent KBM903 (manufactured by Shin-Etsu Silicone) compound 1-1: $(CH_3O)_3Si\text{-}(CH_2)_3\text{-}NH_2$) | 5.53 parts by weight |
| Compound 2-1 | 2.93 parts by weight |
| Compound 2-1 | |

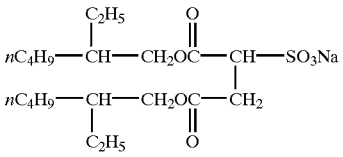

| | |
|---|---|
| SEAHOSTAR KEP50 (amorphous spherical silica, average grain size 0.5 $\mu$m, manufactured by NIPPON SHOKUBAI Co., Ltd.) | 88.00 parts by weight |
| The above foumulation was stirred for 10 min, and The following was further added. | |
| Diacetone alcohol | 252.93 parts by weight |

Under ice cooling and stirring, the above solution was dispersed for 3 hr by using the "SONIFIER450 (manufactured by BRANSON K.K.)" ultrasonic homogenizer, thereby completing the spherical inorganic grain dispersion c1.

(3) Formation of spherical organic polymer grain dispersion

A spherical organic polymer grain dispersion [c2] was formed by the following formulation.

| | |
|---|---|
| XC99-A8808 (manufactured by TOSHIBA SILICONE K.K., spherical cross-linked polysiloxane grain average grain size 0.9 $\mu$m) | 60 parts by weight |
| Methylethylketone | 120 parts by weight |
| Cyclohexanone (solid content 20%, solvent: methylethylketone/cyclohexanone = 1/1) | 120 parts by weight |

Under ice cooling and stirring, the above solution was dispersed for 2 hr by using the "SONIFIER450 (manufactured by BRANSON K.K.)" ultrasonic homogenizer, thereby completing the spherical organic polymer grain dispersion c2.

(4) Formation of third layer coating solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEEHOSTA KEP50 dispersion [c1] | 53.1 g |
| Above-mentioned spherical organic polymer grain dispersion [c2] | 300 g |
| FC431 (manufactured by 3M K.K., solid content 50%, solvent: ethyl acetate) | 2.65 g |
| BYK310 (manufactured by BYK Chemi Japan K.K., solid content 25%) | 5.3 g |

The above third layer coating solution was coated in an amount of 10.35 mL/m$^2$ on the second layer, dried at 110° C., and further dried at 97° C. for 3 min.

2) Coating of light-sensitive layers (making of sample 001)

The opposite side of the back layers obtained as above was coated with a plurality of layers having the following compositions to make a color negative film (sample 001).

(Compositions of Light-sensitive Layers)

The main materials used in the individual layers are classified as follows.

ExC: Cyan coupler UV: Ultraviolet absorbent

ExM: Magenta coupler HBS: High-boiling organic solvent

ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| 1st layer (1st antihalation layer) | | |
|---|---|---|
| Black colloidal silver | silver | 0.122 |
| 0.07- $\mu$m silver iodobromide emulsion | silver | 0.01 |
| Gelatin | | 0.919 |
| ExC-1 | | 0.002 |
| ExC-3 | | 0.002 |
| Cpd-2 | | 0.001 |

-continued

| | | |
|---|---|---|
| HBS-1 | | 0.005 |
| HBS-2 | | 0.002 |
| F-8 | | 0.001 |
| 2nd layer (2nd antihalation layer) | | |
| Black colloidal silver | silver | 0.055 |
| Gelatin | | 0.425 |
| ExM-1 | | 0.002 |
| Solid disperse dye ExF-9 | | 0.120 |
| HBS-1 | | 0.074 |
| F-8 | | 0.001 |
| 3rd layer (Interlayer) | | |
| Cpd-1 | | 0.080 |
| HBS-1 | | 0.042 |
| Gelatin | | 0.300 |
| 4th layer (Low-speed red-sensitive emulsion layer) | | |
| Em-D | silver | 0.577 |
| Em-C | silver | 0.347 |
| ExC-1 | | 0.233 |
| ExC-2 | | 0.026 |
| ExC-3 | | 0.129 |
| ExC-4 | | 0.155 |
| ExC-5 | | 0.029 |
| ExC-6 | | 0.013 |
| Cpd-2 | | 0.025 |
| Cpd-4 | | 0.025 |
| ExC-8 | | 0.050 |
| HBS-1 | | 0.114 |
| HBS-5 | | 0.038 |
| Gelatin | | 1.474 |
| 5th layer (Medium-speed red-sensitive emulsion layer) | | |
| Em-B | silver | 0.431 |
| Em-C | silver | 0.432 |
| ExC-1 | | 0.154 |
| ExC-2 | | 0.037 |
| ExC-3 | | 0.018 |
| ExC-4 | | 0.103 |
| ExC-5 | | 0.037 |
| ExC-6 | | 0.030 |
| Cpd-2 | | 0.036 |
| Cpd-4 | | 0.028 |
| ExC-7 | | 0.010 |
| HBS-1 | | 0.129 |
| Gelatin | | 1.086 |
| 6th layer (High-speed red-sensitive emulsion layer) | | |
| Em-A | silver | 1.108 |
| ExC-1 | | 0.072 |
| ExC-3 | | 0.035 |
| ExC-6 | | 0.029 |
| Cpd-2 | | 0.064 |
| Cpd-4 | | 0.077 |
| ExC-7 | | 0.040 |
| HBS-1 | | 0.329 |
| HBS-2 | | 0.120 |
| Gelatin | | 1.245 |
| 7th layer (Interlayer) | | |
| Cpd-1 | | 0.094 |
| Cpd-9 | | 0.369 |
| Solid disperse dye ExF-4 | | 0.030 |
| HBS-1 | | 0.049 |
| Polyethylacrylate latex | | 0.088 |
| Gelatin | | 0.886 |
| 8th layer (layer for donating interlayer effect to red-sensitive layer) | | |
| Em-J | silver | 0.293 |
| Em-K | silver | 0.293 |
| Cpd-4 | | 0.030 |
| ExM-2 | | 0.057 |
| ExM-3 | | 0.016 |
| ExM-4 | | 0.051 |
| ExY-1 | | 0.008 |
| ExY-6 | | 0.042 |
| ExC-9 | | 0.011 |

-continued

| | | |
|---|---|---|
| HBS-1 | | 0.090 |
| HBS-3 | | 0.003 |
| HBS-5 | | 0.030 |
| Gelatin | | 0.610 |
| 9th layer (Low-speed green-sensitive emulsion layer) | | |
| Em-H | silver | 0.329 |
| Em-G | silver | 0.333 |
| Em-I | silver | 0.088 |
| ExM-2 | | 0.378 |
| ExM-3 | | 0.047 |
| ExY-1 | | 0.009 |
| ExC-9 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| 10th layer (Medium speed green-sensitive emulsion layer) | | |
| Em-F | silver | 0.457 |
| ExM-2 | | 0.049 |
| ExM-3 | | 0.035 |
| ExM-4 | | 0.014 |
| ExY-1 | | 0.003 |
| ExY-5 | | 0.006 |
| ExC-6 | | 0.005 |
| ExC-8 | | 0.010 |
| ExC-9 | | 0.012 |
| HBS-1 | | 0.065 |
| HBS-3 | | 0.002 |
| HBS-5 | | 0.020 |
| Cpd-5 | | 0.004 |
| Gelatin | | 0.446 |
| 11th layer (High-speed green-sensitive emulsion layer) | | |
| Em-E | silver | 0.794 |
| ExC-6 | | 0.002 |
| ExC-7 | | 0.010 |
| ExM-1 | | 0.022 |
| ExM-2 | | 0.045 |
| ExM-3 | | 0.014 |
| ExM-4 | | 0.017 |
| ExY-5 | | 0.003 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethylacrylate latex | | 0.099 |
| Gelatin | | 0.939 |
| 12th layer (Yellow filter layer) | | |
| Cpd-1 | | 0.094 |
| Solid disperse dye ExF-2 | | 0.150 |
| Solid disperse dye ExF-5 | | 0.010 |
| Oil-soluble dye ExF-7 | | 0.010 |
| HBS-1 | | 0.049 |
| Gelatin | | 0.630 |
| 13th layer (Low-speed blue-sensitive emulsion layer) | | |
| Em-O | silver | 0.112 |
| Em-M | silver | 0.320 |
| Em-N | silver | 0.240 |
| ExC-1 | | 0.048 |
| ExY-1 | | 0.012 |
| ExY-2 | | 0.700 |
| ExY-6 | | 0.060 |
| ExC-9 | | 0.012 |
| Cpd-2 | | 0.100 |
| Cpd-3 | | 0.004 |
| HBS-1 | | 0.222 |
| HBS-5 | | 0.074 |
| Gelatin | | 2.058 |

-continued

| | | |
|---|---|---|
| 14th layer (High-speed blue-sensitive emulsion layer) | | |
| Em-L | silver | 0.714 |
| ExY-2 | | 0.211 |
| Cpd-2 | | 0.075 |
| Cpd-3 | | 0.001 |
| HBS-1 | | 0.071 |
| Gelatin | | 0.678 |
| 15th layer (1st protective layer) | | |
| 0.07- μm silver iodobromide emulsion | silver | 0.301 |
| UV-1 | | 0.211 |
| UV-2 | | 0.132 |
| UV-3 | | 0.198 |
| UV-4 | | 0.026 |
| F-11 | | 0.009 |
| S-1 | | 0.086 |
| HBS-1 | | 0.175 |
| HBS-4 | | 0.050 |
| Gelatin | | 1.984 |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| S-1 | | 0.200 |
| Gelatin | | 0.750 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-17, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total | 7.210 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid fine-grain dispersion. The average grain size of the fine dye grains was 0.29 μm.

Following the same procedure as above, solid dispersions of ExF-4 and ExF-9 were obtained. The average grain sizes of the fine dye grains were 0.28 and 0.49 μm, respectively. ExF-5 was dispersed by a microprecipitation dispersion method described in Example 1 of EP549,489A, the disclosure of which is incorporated herein by reference. The average grain size was found to be 0.06 μm.

Compounds used in the formation of each layer were as follows.

ExC-1

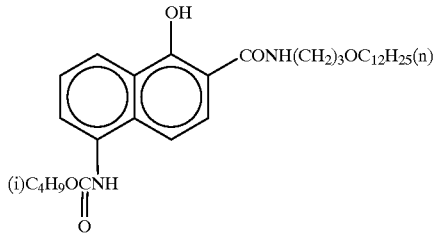

ExC-2

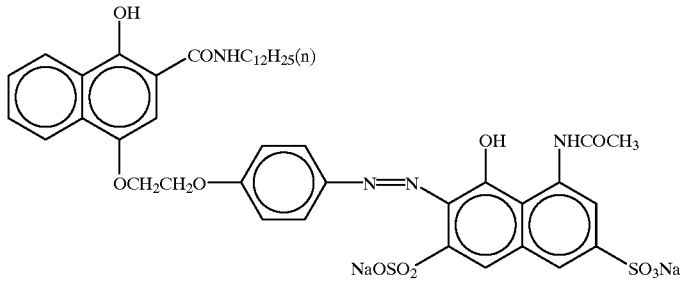

ExC-3

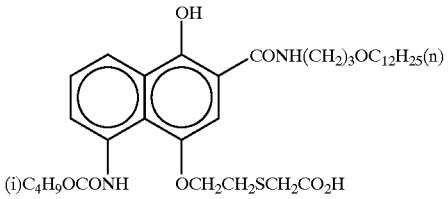

ExC-4

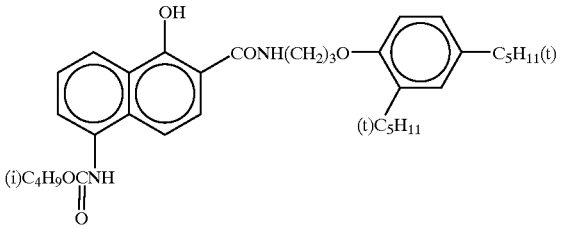

-continued
ExC-5
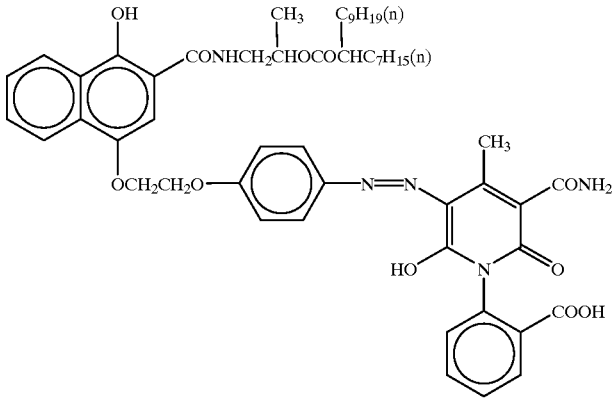
ExC-6
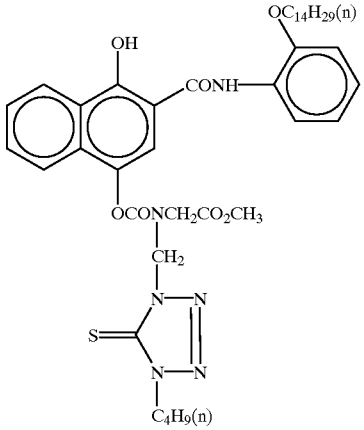
ExC-7
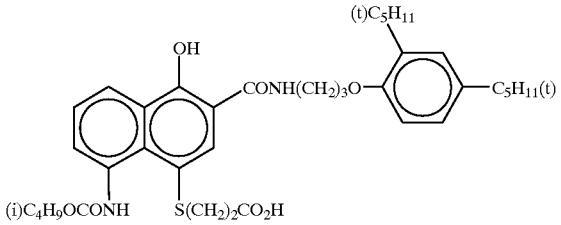
ExC-8
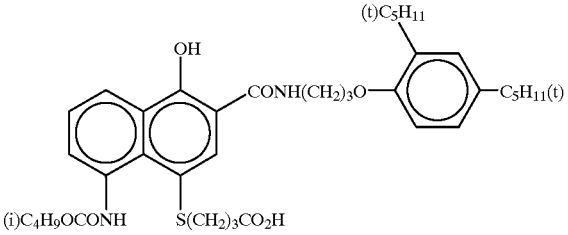
ExC-9
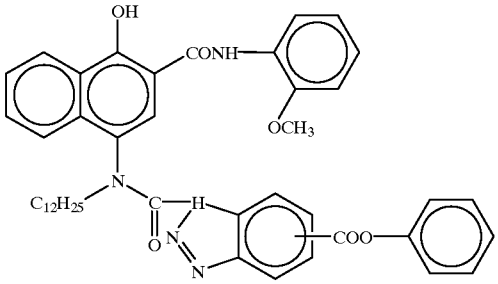
ExM-1
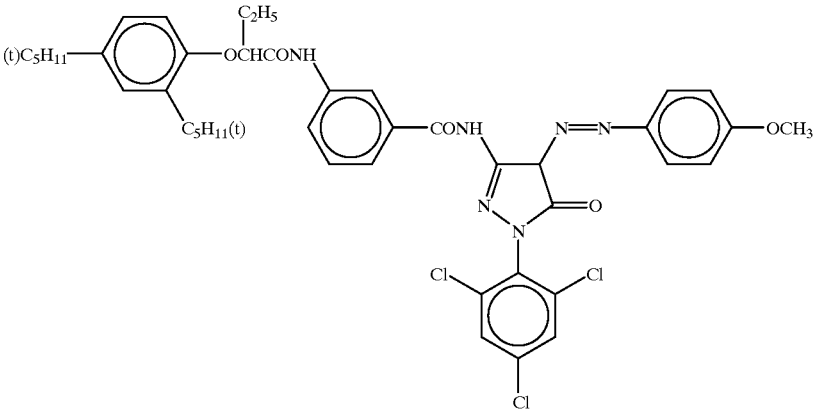

-continued
ExM-2
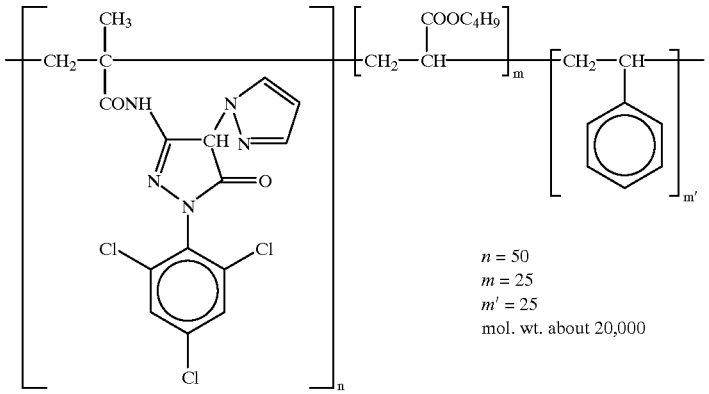
ExM-3
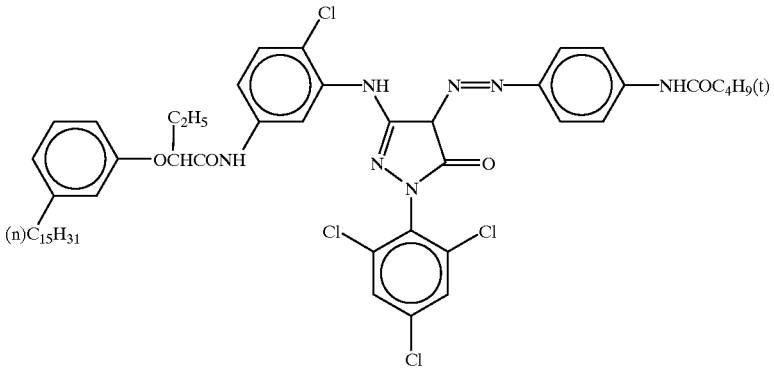
ExM-4
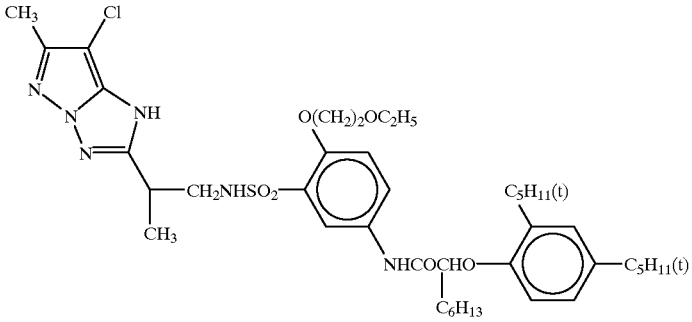
ExY-1
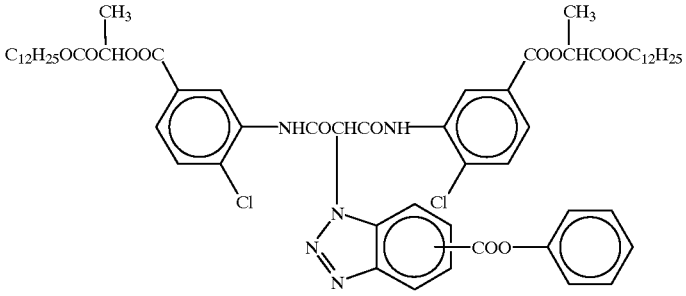

-continued
ExY-2
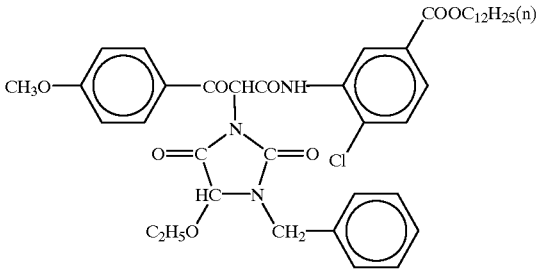
ExY-5
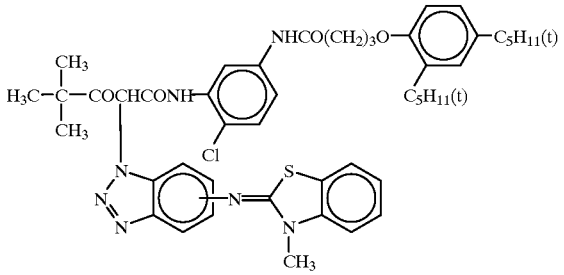
ExY-6
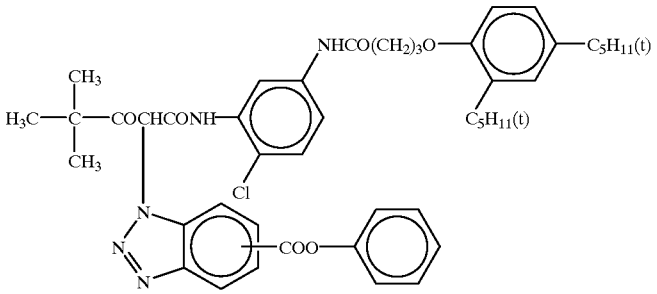
Cpd-1
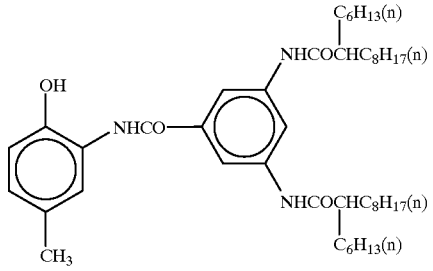
Cpd-2
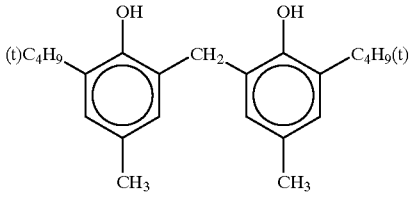
Cpd-3
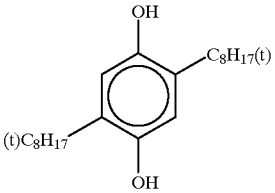
Cpd-4
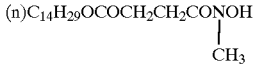
Cpd-5
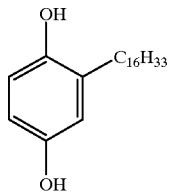
UV-1
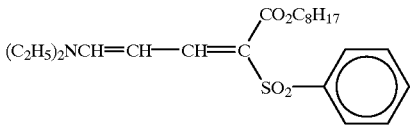
UV-2
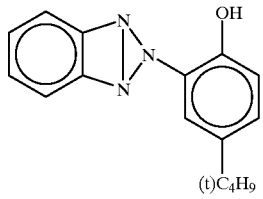
UV-3
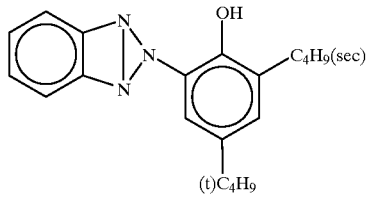

-continued
UV-4
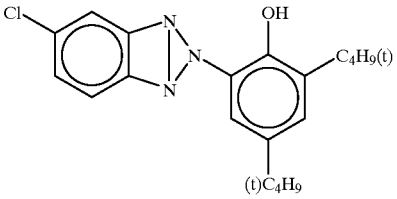
B-1
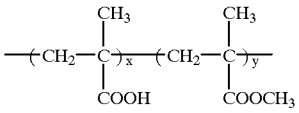
x/y = 10/90 (weight ratio)
Weight-averag molecular weight: about 35,000
B-2
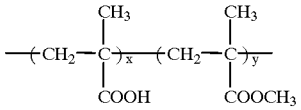
x/y = 40/60 (weight ratio)
Weight-average molecular weight: about 20,000
B-3
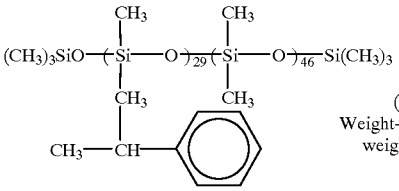
(mole ratio)
Weight-average molecular weight: about 8,000
H-1
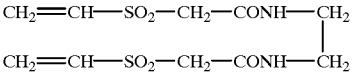
HBS-1
Tricresyl phosphate
S-1
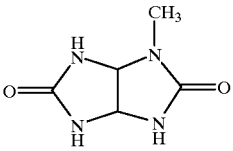
HBS-2
di-n-butyl phthalate
HBS-3
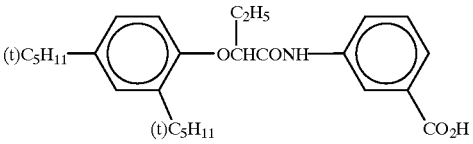
HBS-4
Tri(2-ethylhexyl) phosphate
HBS-5
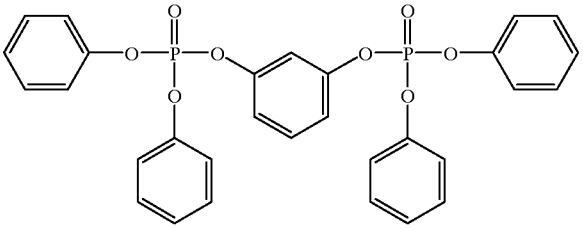
F-1
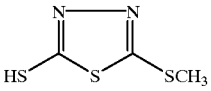
F-2
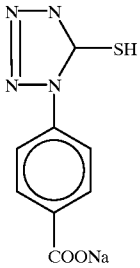
F-3
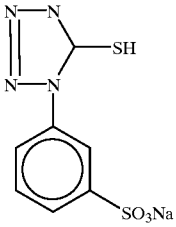
F-4
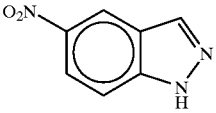

-continued
F-5
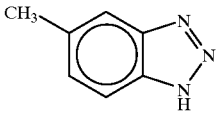
F-6
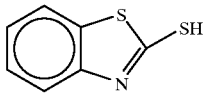
F-7
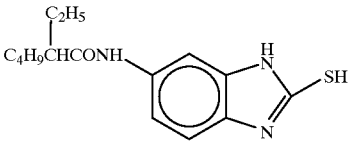
F-8
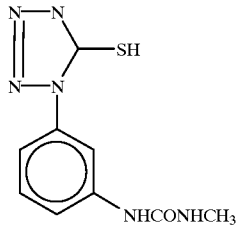
F-9
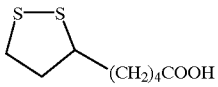
F-10
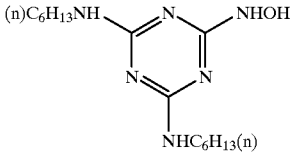
F-11
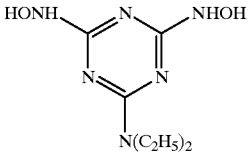
F-12
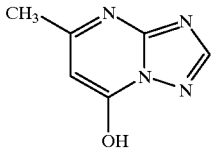
F-13
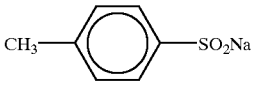
F-14
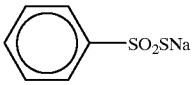
F-15
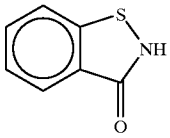
F-16
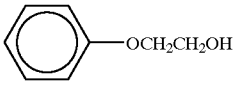
F-17
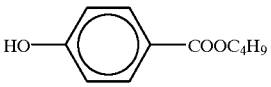
W-1
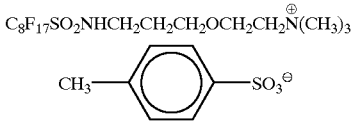
W-2
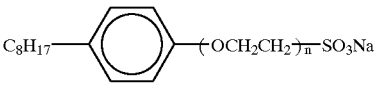
$n = 2 \sim 4$
W-3
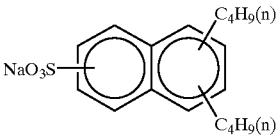
W-4
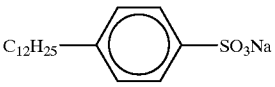
W-5
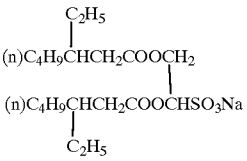

-continued

W-6

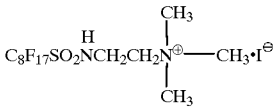

B-4

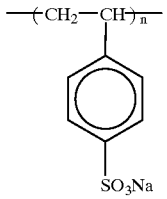

Weight-average molecular weight: about 750,000

B-5

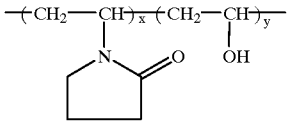

x/y = 70/30 (weight ratio)
Weight-average molecular weight: about 17,000

B-6

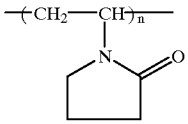

Weight-average molecular weight: about 10,000

Cpd-9

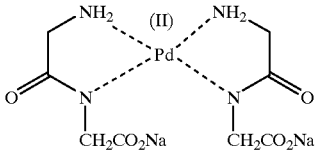

ExF-1

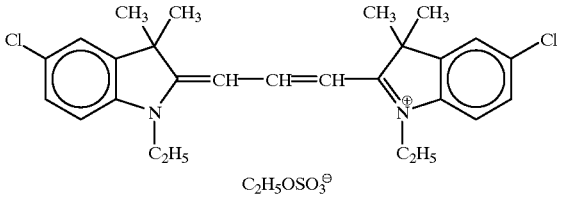

ExF-2

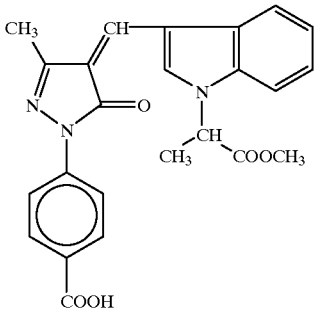

ExF-4

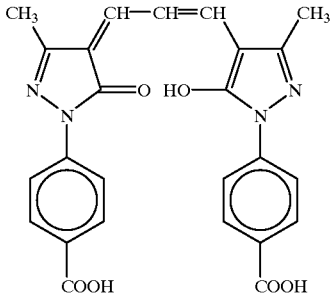

ExF-5

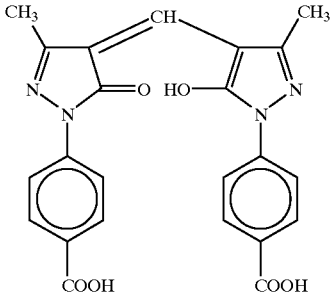

ExF-7

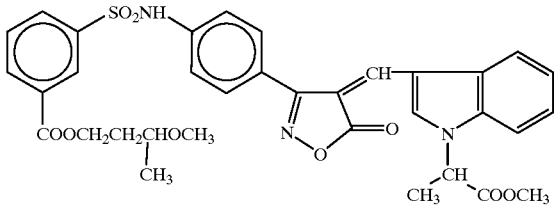

ExF-9

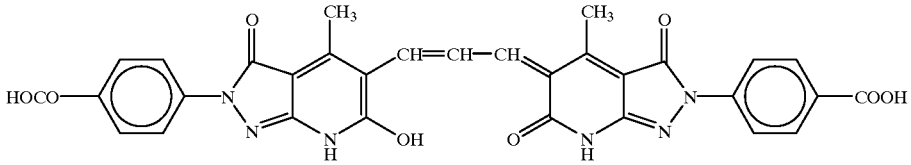

The color negative light-sensitive material formed as above was named sample 001. The weight-average wavelength $\lambda_R$ of the spectral sensitivity of the read-sensitivity layer of this sample 001 was 618 nm.

Sample 001 was exposed for 1/100 sec through a continuous wedge by using a light source described in this specification.

Development was performed as follows by using the FP-360B automatic processor manufactured by Fuji Photo Film Co., Ltd. Note that the FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94–4992, the disclosure of which is incorporated herein by reference.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide light-sensitive material (equivalent to one 24 Ex. 1)

The stabilizer and fixer were returned from (2) to (1) by counterflow, and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide light-sensitive material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |

-continued

| | Tank solution (g) | Replenisher (g) |
|---|---|---|
| Maleic acid | 28 | 42 |
| Water to make | 1.0 L | 1.0 L |
| pH (adjusted by ammonia water) | 4.6 | 4.0 |
| (Fixing (1) tank solution) | | |
| A 5:95 (volume ratio) mixture of the above bleaching tank solution and the following fixing tank solution (pH 6.8). | | |
| (Fixing (2)) | | |
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |
| (Washing water) | | |

(Washing Water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononylphenylether (average polymerization degree 10) | 0.2 |
| 1,2-benzoisothiazoline-3-one sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |
| (Making of sample 002) | |

(Making of Sample 002)

Sample 001 was changed as follows.

The amount of ExC-9 in the 8th layer (layer for donating interlayer effect to red-sensitive layer) was increased to 0.021 $g/m^2$.

The amounts of ExC-6 and ExM-2 in the 11th layer (high-speed green-sensitive emulsion layer) were increased to 0.007 and 0.091 $g/m^2$, respectively.

The amount of ExY-2 in the 14th layer (high-speed blue-sensitive emulsion layer) was increased to 0.348 $g/m^2$. Also, 0.064 $g/m^2$ of ExY-6 were added.

The above changes were made, and the sample was so controlled that its characteristic curve matched sample 001.

(Making of Sample 003)

Sample 002 was changed as follows.

The sensitizing dye amounts in Em-A to Em-D were controlled to set the read-sensitive layer weight-average wavelength $\lambda_R$ at 630 nm.

(Making of Sample 004)

Sample 002 was changed as follows.

The amount of ExC-6 in the 4th layer (low-speed red-sensitive emulsion layer) was decreased to 0.007 g/m$^2$.

The amount of ExY-6 in the 8th layer (layer for donating interlayer effect to red-sensitive layer) was decreased to 0.021 g/m$^2$.

The amount of ExY-6 in the 13th layer (low-speed blue-sensitive emulsion layer) was decreased to 0.020 g/m$^2$.

The sample was also controlled such that its characteristic curve matched sample 001.

(Making of Sample 005)

Sample 002 was changed as follows.

Em-C in the 4th layer (low-speed red-sensitive layer) was removed, and the amount of Em-D was increased to 0.80 g/m$^2$.

Em-B in the 5th layer (medium-speed red-sensitive layer) was removed, and the amount of Em-C was increased to 0.82 g/m$^2$.

Em-A in the 6th layer (high-speed red-sensitive layer) was removed, and 0.95 g/m$^2$ of Em-B were added.

The amount of Em-J in the 8th layer (layer for donating interlayer effect to red-sensitive layer) was decreased to ½, and the amount of Em-K was increased to 0.45 g/m$^2$.

Em-G in the 9th layer (low-speed green-sensitive layer) was removed, and the amount of Em-I was increased to 0.380 g/m$^2$.

Em-F in the 10th layer (medium-speed green-sensitive layer) was removed, and 0.45 g/m$^2$ of Em-G were added.

Em-E in the 11th layer (high-speed green-sensitive layer) was removed, and 0.65 g/m$^2$ of Em-N were added.

Em-M in the 13th layer (low-speed blue-sensitive emulsion layer) was removed, and the amounts of Em-N and Em-O were increased to 0.380 and 0.25 g/m$^2$, respectively.

The amount of Em-L in the 14th layer (high-speed blue-sensitive emulsion layer) was decreased to 0.30 g/m$^2$, and 0.30 g/m$^2$ of Em-M were added.

Sample 005 was also controlled such that its characteristic curve matched sample 002.However, the control is so performed that the relative sensitivity (logarithm) was lower by 0.2 than that of sample 002.

A Macbeth chart was photographed by using these samples 001 to 005, and color saturation evaluation values η described in this specification were calculated. Also, each sample was loaded into the "SUPER SLIM ACE" throw-away camera manufactured by Fuji Photo Film Co., Ltd. and used to perform photographing outdoors (under fine weather and cloudy weather, and in a skiing ground) and indoors, and the finished conditions were examined. The results are shown in Table 5.

TABLE 5

| Sample No. | ISO sensitivity | Evaluation value η | Finished conditions, etc. | |
|---|---|---|---|---|
| 001 | 830 | −17 | Low saturation and no tightness in slight underexposure | Comparative example |
| 002 | 830 | −11 | Best of five samples | Example of present invention |
| 003 | 830 | −11 | Slightly greenish finish when indoor fluorescent lamps were mixed | Example of present invention |
| 004 | 830 | −16 | No saturated colors were obtained in overexposure | Comparative example |
| 005 | 520 | −12 | Some underexposed scenes were found | Comparative example |

Sample 002 produced saturated colors and had tightness even in slightly underexposed scenes and was also excellent in overexposure. Furthermore, the colors were greened little with fluorescent lamps, indicating favorable results.

EXAMPLE 2

Triacetylcellulose film supports were coated with samples 001 to 005. Each resultant film was formed into a 135 format and loaded into a compact zoom camera (focal length=38 to 115 mm, F value=4.5/9.7), thereby conducting tests analogous to those in Example 1. Consequently, color negative light-sensitive materials (samples 002 and 003) of the present invention exhibited favorable results as in Example 1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photographic light-sensitive material comprising, on a support, a red-sensitive layer unit including at least one red-sensitive silver halide emulsion layer, a green-sensitive layer unit including at least one green-sensitive silver halide emulsion layer, and a blue-sensitive layer unit including at least one blue-sensitive silver halide emulsion layer, said light-sensitive material having an ISO sensitivity of not less than 640, wherein said material exhibits a color saturation evaluation value η, represented by equation (I) below, of not less than −15 dB:

$$\eta=10\ log(1/V_T)$$

$$[V_T=(1/6)\times((62-Y_1)^2+(62-Y_2)^2+(62-Y_3)^2+(62-Y_4)^2+(62-Y_5)^2+(62-Y_6)^2)] \quad (I)$$

where each of Y1 to Y6 is a value obtained by exposing 12 colors of a Macbeth color chart with six exposure amounts, from −1 under to +4 over, measuring the saturation of each resultant color, and averaging the data (chroma values) for a corresponding exposure amount.

2. The material according to claim 1, wherein a weight-average wavelength $\lambda_R$, represented by equation (II) below, of said red-sensitive silver halide emulsion layer is not more than 625 nm:

$$\lambda_R = \frac{\int_{550}^{700} \lambda S_R(\lambda)\, d\lambda}{\int_{550}^{700} S_R(\lambda)\, d\lambda} \quad (II)$$

where $S_R(\lambda)$ is the spectral sensitivity distribution curve of said red-sensitive silver halide emulsion layer, and $S_R$ at a specific wavelength λ is represented by the reciprocal of an exposure amount by which a cyan density is fog +0.5 when exposed to the specific wavelength.

3. The material according to claim 2, wherein the weight-average wavelength $\lambda_R$ of said red-sensitive silver halide emulsion layer is 600 to 620 nm.

4. The material according to claim 1, wherein 50% or more of the total projected area of silver halide grains contained in at least one of highest-sensitivity emulsion layer in said red-sensitive layer unit, highest-sensitivity emulsion layer in said green-sensitive layer unit and highest-sensitivity emulsion layer in said blue-sensitive layer unit are tabular silver halide grains having an average aspect ratio of 8 or more.

5. The material according to claim 4, wherein the tabular silver halide grains have 10 or more dislocation lines per grain in average.

6. The material according to claim 1, wherein the silver halide emulsion contained in at least one of the silver halide emulsion layers is subjected to selenium sensitization.

7. The material according to claim 6, wherein the selenium sensitization is subjected by using at least one selected from compounds represented by formulas (A) and (B):

(A)

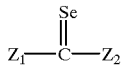

where each of $Z_1$ and $Z_2$ independently represents an alkyl group, an alkenyl group, an aralkyl group, an aryl group, a heterocyclic group, —$NR_1(R_2)$, —$OR_3$, or —$SR_4$, each of $R_1$, $R_2$, $R_3$, and $R_4$ independently represents a hydrogen atom, an alkyl group, an aralkyl group, an aryl group, a heterocyclic group, or an acyl group.

(B)

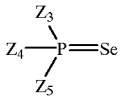

where each of $Z_3$, $Z_4$, and $Z_5$ independently represents an alkyl group, an alkenyl group, an alkinyl group, an aralkyl group, an aryl group, a heterocyclic group, —$OR_7$, —$NR_8(R_9)$, —$SR_{10}$, —$SeR_{11}$, X, or a hydrogen atom, each of $R_7$, $R_{10}$, and $R_{11}$ independently represents an alkyl group, an alkenyl group, an alkinyl group, an aralkyl group, an aryl group, a heterocyclic group, a hydrogen atom, or a cation, each of $R_8$ and $R_9$ independently represents an alkyl group, an alkenyl group, an alkinyl group, an aralkyl group, an aryl group, a heterocyclic group, or a hydrogen atom, and X represents a halogen atom.

8. The material according to claim 1, wherein a weight-average sensitivity wavelength $\lambda_G$, represented by equation (III) below, of the spectral sensitivity distribution of the green-sensitive silver halide emulsion layer is 520 nm$<\lambda_G\leqq$580 nm, a weight-average wavelength ($\lambda_{-R}$) of the spectral sensitivity distribution of the interlayer effect, which the red-sensitive silver halide emulsion layer is given from other silver halide emulsion layers within the range of 500 to 600 nm, is 500 nm$<\lambda_{-R}\leqq$560 nm, and $\lambda_G-\lambda_{-R}$ is 5 nm or more:

$$\lambda_G = \frac{\int_{500}^{600} \lambda S_G(\lambda)\, d\lambda}{\int_{500}^{600} S_G(\lambda)\, d\lambda} \quad \text{(III)}$$

where $S_G(\lambda)$ is the spectral sensitivity distribution curve of the green-sensitive silver halide emulsion layer, and $S_G$ at a specific wavelength $\lambda$ is represented by the reciprocal of an exposure amount by which a cyan density is fog +0.5 when exposed to the specific wavelength.

9. The material according to claim 4, wherein the silver halide grains contained in at least one of highest-sensitivity emulsion layer in said unit red-sensitive layer, highest-sensitivity emulsion layer in said unit green-sensitive layer and highest-sensitivity emulsion layer in said unit blue-sensitive layer are doped with at least one dopant selected from Fe, Co, Ni, Ru, Rh, Pd, Re, Os, Ir, Pt, Au, Hg, Pb and Tl.

10. The material according to claim 9, wherein the dopants are metal complexes selected from a hexacyano iron(II) complex and a hexacyanoruthenium complex.

11. The material according to claim 10, wherein 50% or more of the total content of metal complexes contained in the silver halide grain are contained in a layer ½ or less as a silver amount from the outermost surface of the grain.

12. A photographic unit containing the silver halide color photographic light-sensitive material according to claim 1 and comprising an exposure mechanism which includes a photographing lens and shutter.

13. A photographic unit containing the silver halide color photographic light-sensitive material according to claim 2 and comprising an exposure mechanism which includes a photographing lens and shutter.

14. A photographic unit containing the silver halide color photographic light-sensitive material according to claim 3 and comprising an exposure mechanism which includes a photographing lens and shutter.

15. A photographic unit containing the silver halide color photographic light-sensitive material according to claim 4 and comprising an exposure mechanism which includes a photographing lens and shutter.

16. A photographic unit containing the silver halide color photographic light-sensitive material according to claim 5 and comprising an exposure mechanism which includes a photographing lens and shutter.

17. A photographic unit containing the silver halide color photographic light-sensitive material according to claim 6 and comprising an exposure mechanism which includes a photographing lens and shutter.

18. A photographic unit containing the silver halide color photographic light-sensitive material according to claim 7 and comprising an exposure mechanism which includes a photographing lens and shutter.

19. A photographic unit containing the silver halide color photographic light-sensitive material according to claim 8 and comprising an exposure mechanism which includes a photographing lens and shutter.

20. A photographic unit containing the silver halide color photographic light-sensitive material according to claim 9 and comprising an exposure mechanism which includes a photographing lens and shutter.

21. A photographic unit containing the silver halide color photographic light-sensitive material according to claim 10 and comprising an exposure mechanism which includes a photographing lens and shutter.

22. A photographic unit containing the silver halide color photographic light-sensitive material according to claim 11 and comprising an exposure mechanism which includes a photographing lens and shutter.

* * * * *